US011074893B1

(12) United States Patent
Zorich

(10) Patent No.: US 11,074,893 B1
(45) Date of Patent: Jul. 27, 2021

(54) TUNING ASSEMBLY FOR STRINGED INSTRUMENT

(71) Applicant: Peachtree Bridge Enterprises, LLC, Roswell, GA (US)

(72) Inventor: Robert Zorich, Brookhaven, GA (US)

(73) Assignee: Peachtree Bridge Enterprises, LLC, Roswell, GA (US)

( * ) Notice: Subject to any disclaimer, the term of this patent is extended or adjusted under 35 U.S.C. 154(b) by 0 days.

(21) Appl. No.: 17/070,485

(22) Filed: Oct. 14, 2020

(51) Int. Cl.
*G10D 3/14* (2020.01)
*G10D 3/12* (2020.01)

(52) U.S. Cl.
CPC ..... *G10D 3/14* (2013.01); *G10D 3/12* (2013.01)

(58) Field of Classification Search
CPC ..... G10D 13/12; G10D 13/00; G10D 3/14; G10D 3/147
See application file for complete search history.

(56) References Cited

U.S. PATENT DOCUMENTS 3,403,588 A * 10/1968 Downing ..... G10D 3/14 84/306
2002/0026864 A1 3/2002 Gotoh
2004/0094013 A1 5/2004 Gotoh
2008/0229898 A1 9/2008 Steinberger
2009/0211427 A1 8/2009 Box et al.
2016/0086586 A1 3/2016 Steinberger
2020/0227011 A1 7/2020 Steinberger

* cited by examiner

*Primary Examiner* — Kimberly R Lockett
(74) *Attorney, Agent, or Firm* — Clements Bernard Walker; Richard A. Walker

(57) ABSTRACT

Tuning assemblies for stringed musical instruments are provided. One implementation of a tuning assembly includes a housing that includes a plurality of worm wheel chambers, a plurality of worm shaft chambers, and a plurality of string slots. The tuning assembly may also include a plurality of worm wheels configured to reside within the worm wheel chambers of the housing. Each worm wheel may be configured to rotate about a longitudinal axis thereof. Also, each worm wheel may include a first worm gear and a string anchor through-hole. The tuning assembly may also include a plurality of worm shafts configured to reside within the worm shaft chambers of the housing. Each worm shaft may be configured to rotate about a longitudinal axis thereof and may include a second worm gear, which may be configured for engagement with the first worm gear to enable tuning of the strings of an instrument.

20 Claims, 11 Drawing Sheets

TUNING ASSEMBLY FOR STRINGED INSTRUMENT

TECHNICAL FIELD

The present disclosure generally relates to tuning assemblies for tuning the strings of a stringed instrument. More particularly, the present disclosure relates to tuning assemblies having a compact size to allow placement of the tuning assemblies in protected areas of the stringed instruments.

BACKGROUND

FIG. 1 is a front view of a conventional electric guitar 10. The electric guitar 10 includes a body 12, a neck 14, and a head 16, arranged in a conventional manner. Strings 18 are stretched across the front portion (e.g., fingerboard) of the neck 14 between tuning devices 20 arranged on the head 16 and a bridge 22 secured to the body 12. The bridge 22 may include saddles 24 that are configured to define first nodes of the strings 18. Also, a nut 26 is arranged at or near the border between the neck 14 and head 16, whereby the nut 26 defines second nodes of the strings 18. The nodes (i.e., at the saddles 24 and nut 26) are configured at a certain distance apart from each other for allowing the strings 18 to produce musical tones as is known. The tuning devices 20 are configured to stretch the strings 18 so as to adjust (or tune) the strings 18 to predetermined frequencies along the musical scale according to standard tuning practices. The tuning devices 20 in this example include at least posts 28 connected to the top ends of the strings. These posts 28 can be rotated by turning respective knobs 30. In this example, the head 16 may be configured to support a string tree 32 for changing the string angle so as to prevent the strings connected to posts 28 farthest from the nut 26 from contacting the top surface of the head 16.

FIG. 2 is a front view of a tuning mechanism 40 having six different tuning devices for tuning each of the six strings of a conventional acoustic guitar. Again, the tuning mechanism 40 is mounted on a head 42 of the acoustic guitar. Each tuning device of the tuning mechanism 40 includes posts 44, each of which is configured to hold an end portion of the strings to be tuned. The posts 44 are configured to rotate when knobs 46 of a respective tuning device is twisted. The rotation of a post 44 in one direction causes the respective string to be stretched tighter, while rotation in the other direction cause the string to be loosened. The tightening action and/or loosening action causes the string to change the pitch or frequency.

FIG. 3 is a back view of the head 42 of the conventional acoustic guitar shown in FIG. 2 for showing the conventional tuning mechanism 40. The knob 46 of each tuning device is attached to a rod 48, which in turn is attached to a gear 50. For example, the gear 50 may include a first set teeth on the rod 48 that engages with a second set of teeth on the posts 44 (shown in FIG. 2). Therefore, by twisting the knob 46, the rotation of the rod 48 causes the gear 50 to convey force on the posts 44 to rotate the posts 44 to tune the strings, according to known tuning procedures. The tuning mechanism 40 in this embodiment may also include locking mechanisms 52, which can be used for tightening the gear 50 to prevent the gears 50 from being forced to a more loosened and more natural condition, but which would result in the strings becoming out of tune.

Generally, electric guitars and acoustic guitars (as shown in FIGS. 1-3) have tuning mechanisms that are positioned on the head 16, 42 of the guitars. Each of the tuning devices 20, 40 is used to tune one of multiple strings of the guitar. Although the arrangement of tuning mechanisms may be easy to access, the knobs 30, 46 are typically arranged in a location where they may be accidentally bumped. Sometimes, even a small amount of force applied to the knobs 30, 46 may accidentally cause one or more strings to be stretched or loosened, which may result in one or more of the strings being knocked out-of-tune. In particular, when a guitar is handled or transported (e.g., to be played at a different location), the strings can easily be forced out-of-tune.

There are several disadvantages to this setup of the placement of tuning devices on the head 16, 42. First is that the extra weight of the head 16, 42 at a distance from the body 12 of the instrument provides a significant amount of cantilever force. A standard head 16, 42 may extend about seven to ten inches beyond the nut 26 at the end of the fingerboard. This can result in unbalanced instruments, creating a condition called "neck diving," requiring a player to hold up the neck of the instrument with the same hand they are attempting to play the instrument with, making the instrument more difficult to play.

Having this much weight at the end of the neck also makes the probability of damage of the neck much higher in the event of a fall. Certain brands (e.g., Gibson) have had problems with headstock breakage, which requires a more complex neck manufacturing process to minimize the chances of damage. Some brands (e.g., Fender) use a different neck design that extends the head of the guitar out farther from the nut, but this adds to the leverage or cantilever force and also can cause the strings to have inadequate string angle on some of the strings, causing them to pop out of their slots of the nut in some cases. This results in the need for the string trees 32 shown in the design of FIG. 1 for holding the strings in place.

Yet another disadvantage of having extra weight in the head is the sheer size of the instrument that is required to counterbalance it. In trying to balance the guitar, the shape and weight of the body becomes critical, and mass and size need to be added behind the bridge to help counter the leveraged/cantilevered mass of the tuners. Smaller instruments using standard scale lengths can be challenging to design and build with these constraints.

These problems have been recognized for some time and many attempts have been made to create "headless" guitars. In these cases, strings are secured directly to the head, right behind the nut. This eliminates some of the problems associated with the head weight by moving the tuning machines to the body. Given the size of most tuning machines, they cannot be placed together close enough to work well on the body. This has led to some unorthodox and, in many cases, complex and ungainly solutions using pulleys, rollers, highly angled string trees and other mechanisms to allow them to be usable in this space. It also should be noted that another issue with guitar design that should be addressed is that the string-to-string dimensions at the bridge should remain fixed for playability. Many players find these setups awkward and unattractive.

A standard string usually has a "ball" attached to one end of the string, with the other end left free to allow for adjustable scale lengths. The end with the ball in a traditional-style guitar is normally secured to the bridge on the body of the guitar. The string is positioned across the saddles 24 and nut 26 and the free end of the string is then wrapped around the tuning "peg" or posts 28 and may loosely secured in place with a finger-tightened screw that extends through the tuning post 28, 44, adding even more to the size and weight of the tuning machine, as well as adding cost and manufacturing complexity.

Thus, the typical tuning machine works by wrapping a string around a post and rotating the post using worm gears to tighten the string. In order to address some of the above disadvantages of tuning machines, however, Ned Steinberger provides a type of tuning machine for a headless guitar. The Steinberger tuner is configured instead to pull the string straight back into a housing, which allows each of the tuners to be narrow and sit next to one another on the body of the guitar, immediately behind the bridge. However, this advantage is offset with certain disadvantages. First is that Steinberger's design requires mechanisms to hold the strings at both ends. The Steinberger approach required specialized strings of very specific lengths and balls on both ends of the strings. This made for much more expensive strings that could only be used on Steinberger guitars of a particular scale length. Other similar designs use a specialized headpiece that utilizes a screw to hold the end of a standard string in place. Although these tuning mechanisms may work sufficiently, these tuning screws in this design are so small that the player is required to use a special tool to secure the string. Also, this conventional design adds weight and complexity back to the head of the guitar. Another disadvantage is that there is a possibility of the string slipping loose.

Another problem with the Steinberger design is that with the strings so close together, only a knurled nut can be used to finger-tighten the tuners. This is uncomfortable for the user and it can be difficult to properly tune the strings, especially for fine precise tuning. As a result, many people must use tools to tune these types of guitars. Also, it may require that an open area be present immediately behind the tuners, in line with the neck, to even be able to reach the tuner knobs. This severely limits the shape and design of the instrument's body.

Yet another issue with the Steinberger system is the bridge placement and intonation. The tuners must be placed far enough behind the bridge to allow individual saddles to be adjusted for precise pitch throughout the range of the fingerboard, and to allow enough of a string angle to hold the string in the saddle. Otherwise, the player can experience a similar problem as the one described above with strings slipping out of their assigned slots. Finally, these conventional tuners are quite long. Coupled with the bridge to tuner distance required, this makes the body of the guitar significantly longer. If the body of an instrument is too heavy, the neck will want to pull up, rather than dive, and the player must now hold the neck down while playing.

Therefore, the problems of both standard systems and headless systems tend to complicate the design of stringed instruments, making standard instruments larger than required and making smaller headless instruments less popular and hard to use, while limiting the capabilities of smaller compact "travel" and educational instruments. Thus, there is a need in the field of stringed instruments to provide a tuning mechanism that has a more compact tuning mechanism that can be hidden or positioned at a certain location with respect to the stringed instrument to prevent the strings from accidentally being forced out-of-tune. Also, there is need for tuning mechanisms that may be placed on smaller stringed instruments (or stringed instruments having a size that is reduced compared with conventionally-sized instruments), whereby these smaller instruments may have the advantage of being more easily transported.

BRIEF SUMMARY

The present disclosure describes many aspects of tuning assemblies for tuning the strings of a stringed instrument, such as an electric guitar. Each of the various embodiments of the tuning assemblies may include a compact housing having cylindrical chambers for accommodating gears used for tuning strings within the interior volume of the housing. In many cases, the housing may be mounted within a body of the stringed instrument or within a recess on a back side of the body.

According to one embodiment of the present disclosure, a tuning assembly may include a housing that includes a plurality of worm wheel chambers, a plurality of worm shaft chambers, and a plurality of string slots. The tuning assembly further includes a plurality of worm wheels configured to reside within the worm wheel chambers of the housing, such that each worm wheel is configured to rotate about a longitudinal axis thereof. Each worm wheel may include a first worm gear and a string anchor through-hole. Also, the tuning assembly includes a plurality of worm shafts configured to reside within the worm shaft chambers of the housing. Each worm shaft may be configured to rotate about a longitudinal axis thereof and may include a second worm gear.

According to another embodiment of the present disclosure, a tuning module may include a housing that includes a worm wheel chamber, a worm shaft chamber, and a string slot. A worm wheel may include a first worm gear and a string anchor through-hole. The worm wheel may be configured to reside within the worm wheel chamber of the housing and rotate about a longitudinal axis of the worm wheel. A worm shaft may include a second worm gear and may be configured to reside within the worm shaft chamber of the housing and rotate about a longitudinal axis of the worm shaft.

According to yet another embodiment of the present disclosure, a stringed instrument may include a plurality of strings and a tuning assembly configured to individually tune each of the plurality of strings. The tuning assembly may include a housing that includes a plurality of worm wheel chambers, a plurality of worm shaft chambers, and a plurality of string slots through which free ends of the strings are inserted. The tuning assembly may further include a plurality of worm wheels configured to reside within the worm wheel chambers of the housing, where each worm wheel is configured to rotate about a longitudinal axis thereof and may include a first worm gear and a string anchor through-hole. Furthermore, the tuning assembly may include a plurality of worm shafts configured to reside within the worm shaft chambers of the housing, where each worm shaft may be configured to rotate about a longitudinal axis thereof and may include a second worm gear, which may engage with the first worm gear for enabling tuning of the strings.

BRIEF DESCRIPTION OF THE DRAWINGS

The present disclosure is illustrated and described herein with reference to the various drawings. Like reference numbers are used to denote like components/steps, as appropriate. Unless otherwise noted, components depicted in the drawings are not necessarily drawn to scale.

DETAILED DESCRIPTION

The present disclosure is directed to various tuning mechanisms that may be used for tuning the strings of a stringed instrument, such as an electric guitar, acoustic guitar, mandolin, electric bass, upright bass, banjo, violin, cello, or other types of stringed instruments. In the examples shown throughout the present disclosure, the embodiments of the tuning mechanisms are described with respect to a six-string electric guitar. However, it should be understood that the tuning mechanisms may be used for any type of stringed instrument having any number of strings. Also, the specific embodiments of the tuning mechanisms of the present disclosure are shown so as to allow the tuning mechanism to tune up to six strings of an instrument. However, it should also be understood that the particular embodiments may be adjusted, as would be clearly ascertained from the teachings of the present disclosure, to be able to tune any stringed instrument having any number of strings.

Figure 1:
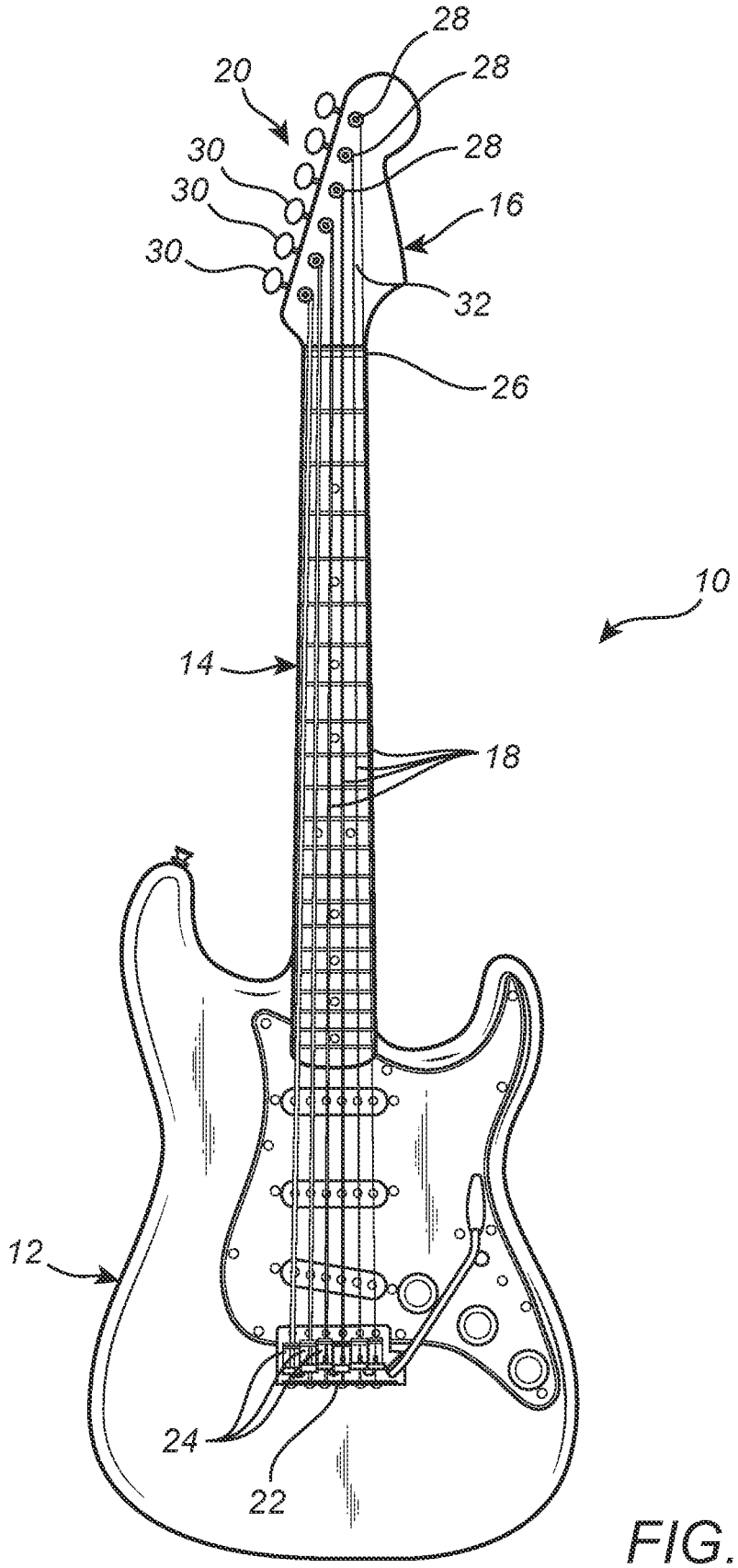
FIG. 1 Prior art
FIG. 1 is a front view of a conventional electric guitar.
Figure 2:
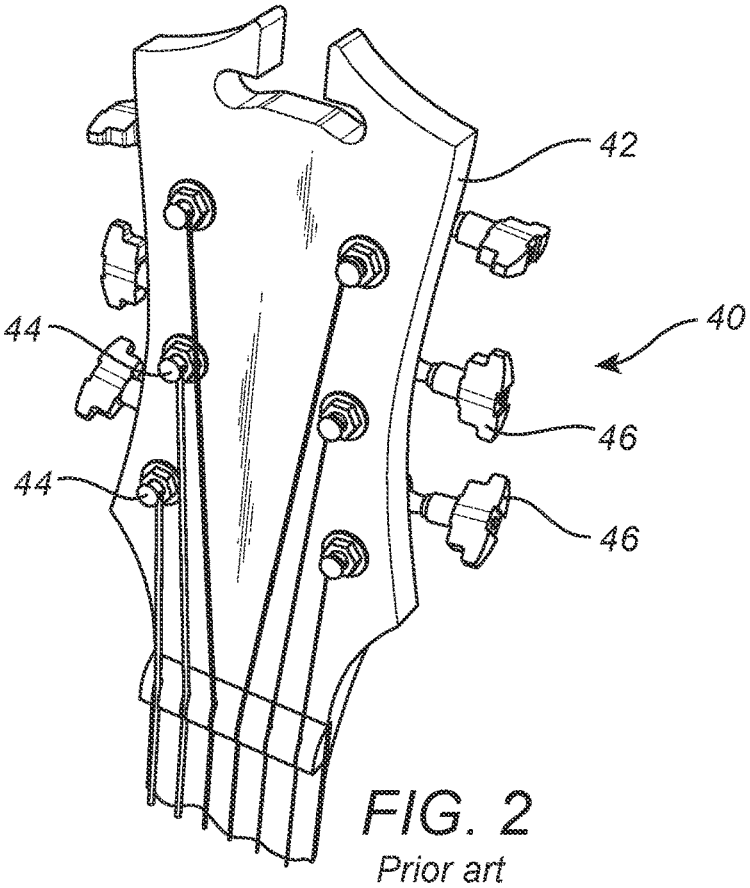
FIG. 2 Prior art
FIG. 2 is a front view of a tuning mechanism arranged on a head of a conventional acoustic guitar.
Figure 4:
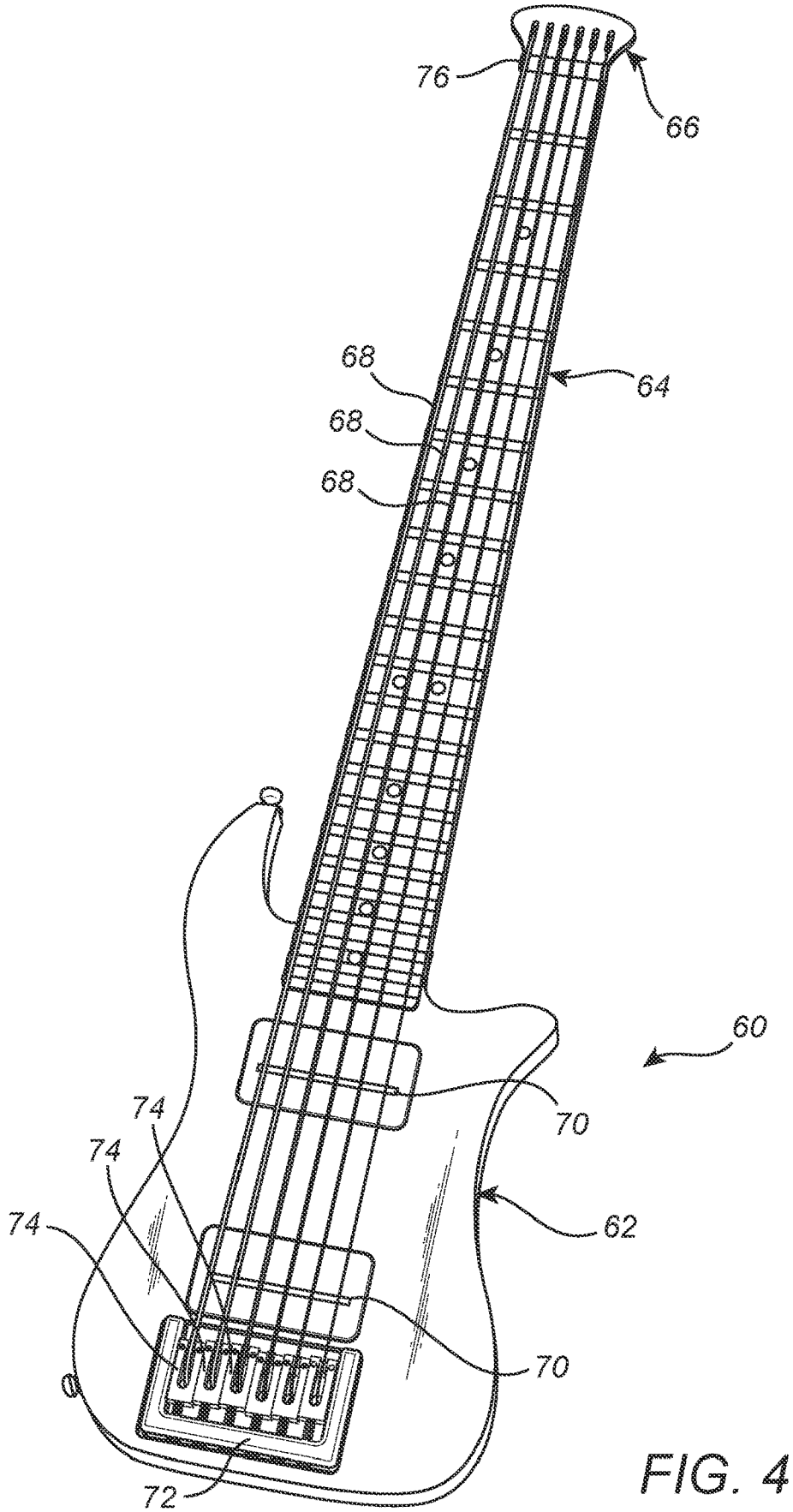
FIG. 4 is a front view of a headless electric guitar according to various embodiments of the present disclosure.
Figure 5:
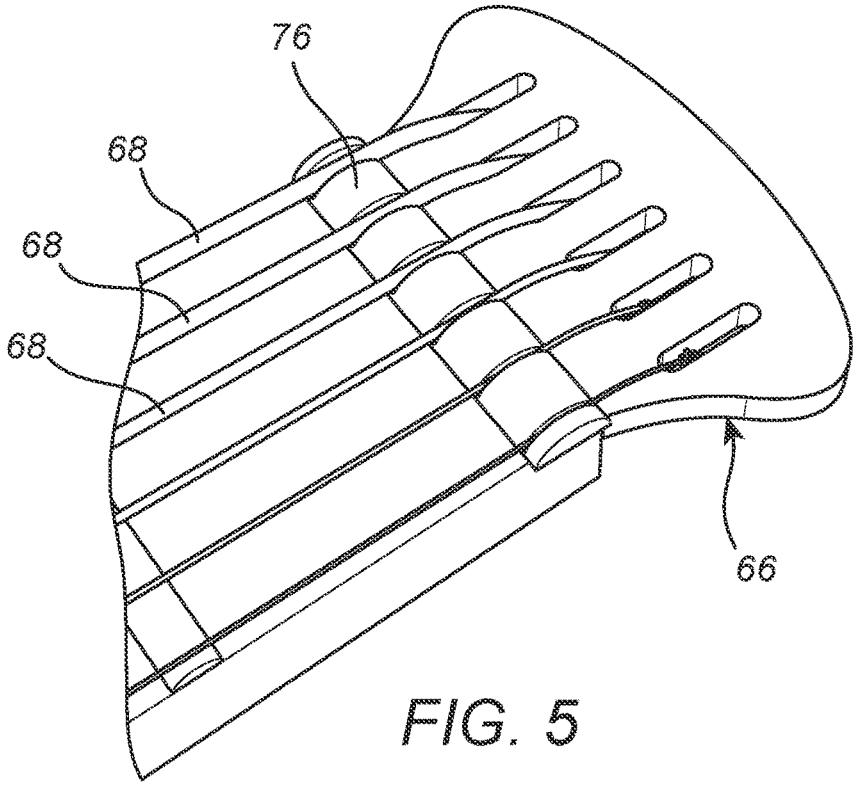
FIG. 5 is a front view of a stub of the headless electric guitar of FIG. 4, according to various embodiments.

FIG. 4 is a front view of an embodiment of a headless electric guitar 60 showing some of the particular aspects of a novel type of tuning mechanism as described in the present disclosure. Also, FIG. 5 shows a top portion of the headless electric guitar 60. The headless electric guitar 60 of FIGS. 4 and 5 includes a body 62, neck 64, and stub 66. The body 62, neck 64, and stub 66 may include any suitable material, such as wood, metal, plastic, composite material, or other material or combination of materials. The body 62 may have a reduced size in comparison with a conventional electric guitar (e.g., the electric guitar 10 of FIG. 1). Each of a number of strings 68 may include a ball at one end thereof. The strings 68 may be run through opening 69 in the stub 66 such that the corresponding balls are configured to hold the top end of the strings 68 securely in place. The strings 68 are then stretched out over the finger board and frets of the neck 64. One or more pickups 70 are used to sense the vibration of the strings 68 when played (e.g., struck, plucked, strummed, touched, etc.). Other embodiments may include a similar arrangement of components in an acoustic or non-electric guitar or instrument.

In some embodiments, the strings 68 are stretched out over the neck 64 such that one node of the strings 68 is defined by a bridge 72 having a number of saddles 74 and another node of the strings 68 is defined by a nut 76 at the other end of the neck 64 near the stub 66. However, in contrast to the conventional electric guitar 10 of FIG. 1, the headless electric guitar 60 secures the strings 68 at the stub 66 such that the strings 68 will not be moved with respect to the nut 76 during a tuning process. Instead of tuning at a head of a guitar, as is usually done with the conventional electrical guitar 10 of FIG. 1, the action of tuning the strings 68 of the headless electric guitar 60 is performed at the body 62. As shown in FIG. 4, the tuning mechanism for tuning the strings 68 is hidden in this embodiment. For instance, the tuning mechanism may be positioned inside the body 62 or on a back side of the body 62. According to other embodiments, the bridge 72 and/or saddles 74 may be omitted, whereby the tuning mechanism as described herein may be connected directly to the opposite end (e.g., ball-less end) of the strings 68.

The guitar 60 may be considered to be a travel guitar. The guitar 60 is headless and the tuners are tucked up inside the body 62 behind/under the bridge 72. In this arrangement, there are no string routing schemes to add to the size and complexity. Also, although the controls may be miniaturized, the fingerboard of the neck 64, the pickups 70, and the electronics may have a standard size. However, as described in more detail below, the guitar 60 may include a special kind of mounting scheme used to reduce the space needed for a tuning mechanism or tuning assembly. As a result of the illustrated arrangement, unlike certain conventional arrangements, the guitar 60 does not compromise on capability. The guitar 60 is well-balanced, so that the body 62 can be extremely small. The body 62 can be made of hardwoods not usually used due to their weight, making it very strong and solid. The weight of a standard guitar with such a hardwood body would be over-whelming for many players. The scale length of the neck 64 may have a standard length of approximately 24.75 inches.

Figure 6:
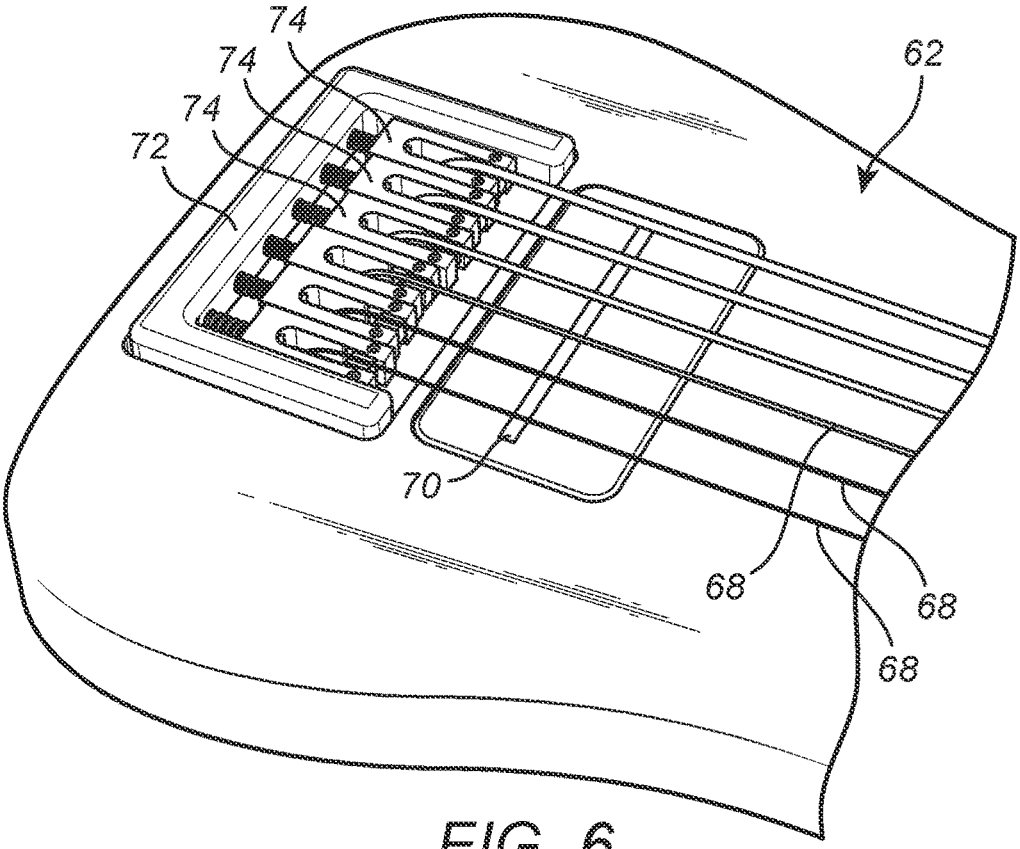
FIG. 6 is a front perspective view of a portion of a body of the headless electric guitar of FIG. 4, according to various embodiments.

FIG. 6 is a front perspective view of a portion of the body 62 of the headless electric guitar 60 of FIG. 4. The saddles 74 are shown in more detail in this figure. The saddles 74 are not configured to be used as fixed nodes along a particular position of the strings 68, as is common with conventional tuning devices, but the saddles 74 instead are actually configured such that, as the strings are tuned (e.g., stretched or loosened), a certain length along the strings 68 may contact the saddles 74, depending on the tuning of the strings 68. This range of stretching allows each string 68 to be tuned to a certain range of frequencies.

Figure 7:
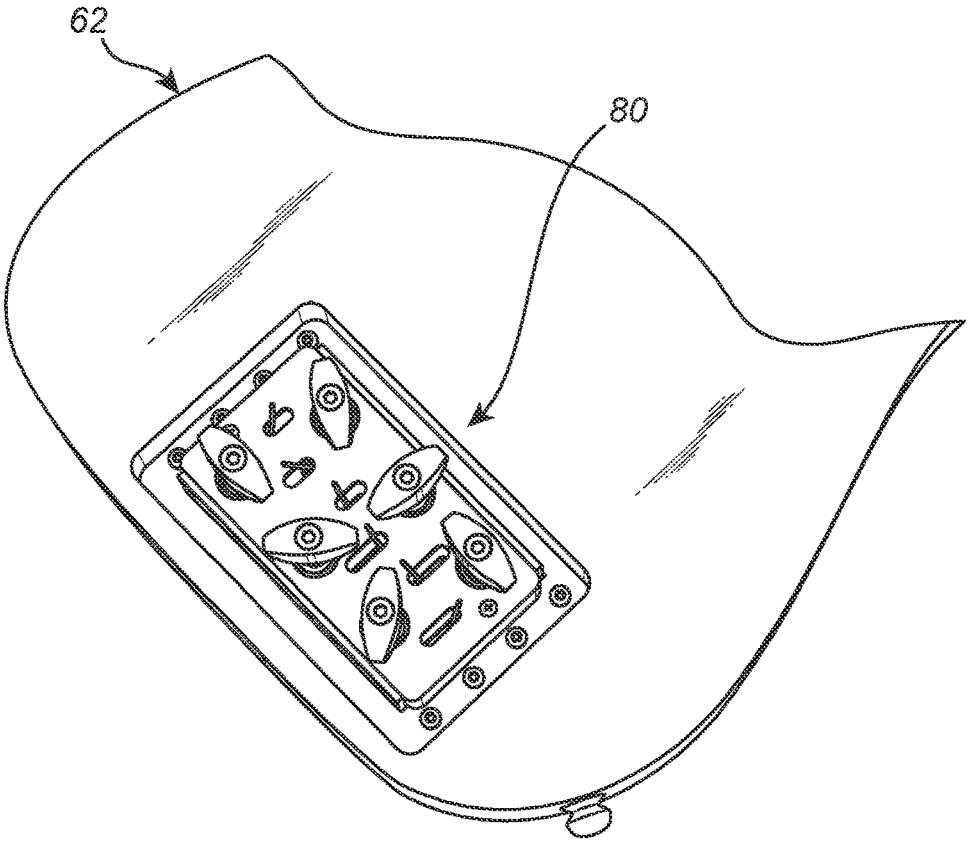
FIG. 7 is a back view of the body of the headless electric guitar of FIG. 4 showing a tuning assembly according to various embodiments of the present disclosure.
Figure 8:
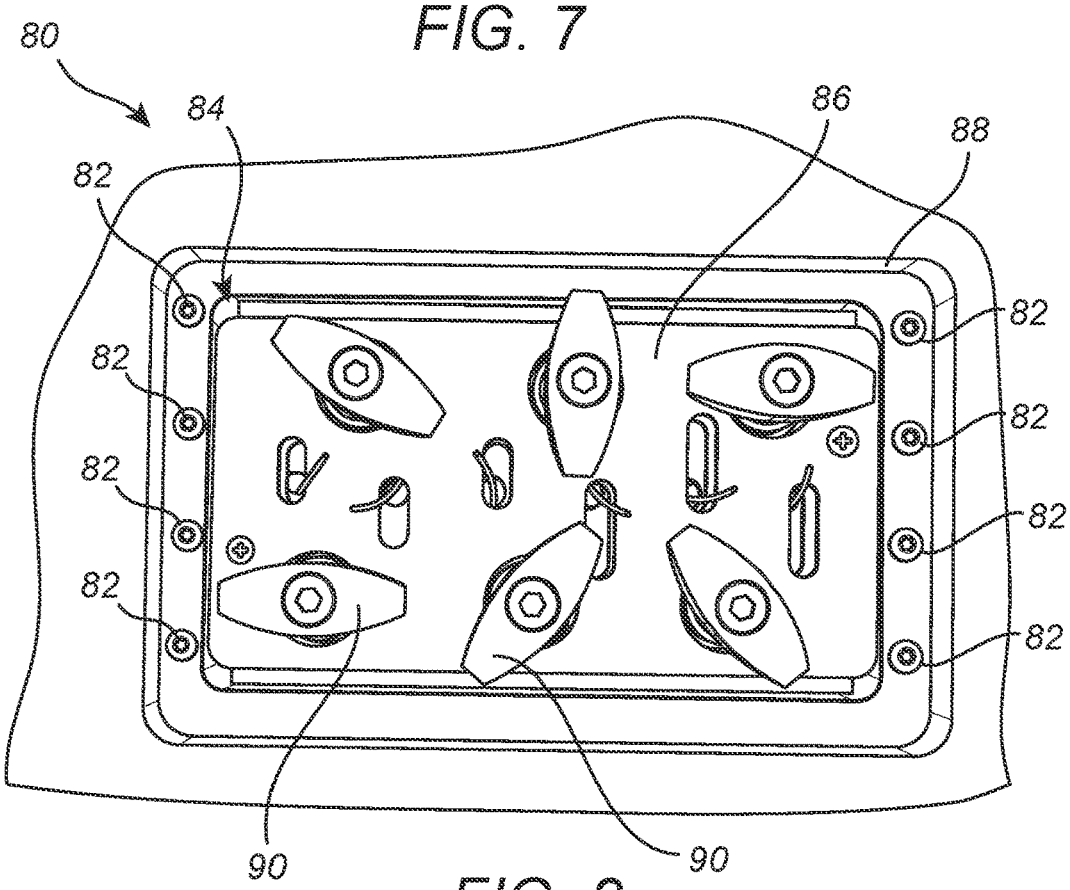
FIG. 8 is a perspective view of the tuning assembly of FIG. 7 mounted within a recess of a back side of the body of the headless electric guitar of FIG. 4, according to various embodiments.

FIG. 7 is a back view of the body 62 of the headless electric guitar 60 of FIG. 4. In this view, a tuning assembly 80 according to various embodiments of the present disclosure is shown. FIG. 8 is a close-up perspective view of the tuning assembly 80 shown in FIG. 7. A number of fasteners 82 (e.g., screws) may be inserted through corresponding holes that extend through the body 62 of the headless electric guitar 60. The fasteners 82 are configured to be connected to corresponding fastener holes (e.g., screw holes) on an underside of the bridge 72 in order to mount the bridge 72, as shown in FIGS. 4 and 6, on a front side of the body 62.

The body 62 also includes a housing opening 84 that extends therethrough. The housing opening 84 is configured to accommodate a housing 86 of the tuning assembly 80. The back side of the body 62 also includes a recess 88 that forms a ledge around the housing opening 84 and provides a space where the holes corresponding to the fasteners 82 can be formed, such as by drilling. The tuning assembly 80 also include a plurality of knobs 90, which can be twisted to tune the strings 68. In some embodiments, the recess 88 may include a depth whereby the knobs 90 are contained below the surface level of the back face of the body 62, such that, if the headless electric guitar 60 were to be placed on its back, the knobs 90 would not contact the ground. According to some embodiments, the space created by the recess 88 may be covered by a door (not shown) or other covering, which may be more comfortable for the player.

In this embodiment, there are three knobs 90 on one side of the housing 86 of the tuning assembly 80 and three knobs 90 on the other side. According to other embodiments, the housing 86 may be configured such that the knobs 90 extend out from the housing 86 in a way where they may be positioned in a line along one side of the housing 86 or along a centerline of the housing 86. In some embodiments, the knobs 90 extend out substantially perpendicular from the housing 86, but in other embodiments, the knobs 90 may be angled at any suitable angle (e.g., about 45° to about 135°), depending on the gear configuration of the tuning assembly 80 as described in more detail below. Also, the number of knobs 90 and corresponding portions of the housing may be changed to accommodate a tuning assembly for tuning any number of strings for any type of stringed instrument. For example, some stringed instruments may have four strings, five strings, six strings, eight strings, twelve strings, or other numbers of strings. In some embodiments, a similar tuning assembly, constructed similarly to the tuning assembly 80 described herein, may be configured for tuning a piano, harp, or other multi-string instrument. Some alternative embodiments may include replacing the knobs 90 used for manual tuning with electric motors or other suitable electromechanical components for electrically and/or automatically tuning the strings.

According to still other alternative embodiments of tuning assemblies consistent with the teachings of the present disclosure, a tuning assembly may be constructed as a combination of any number tuning modules, where each module is configured to tune one or two strings (or any other suitable number). Accordingly, a six-string may be tuned by a tuning assembly that includes three tuning devices where each tuning device is configured to tune two strings. To tune a twelve-string guitar with these tuning module, six of these two-string tuning modules may be combined together. In still other embodiments, the tuner assembly can be mounted directly to the body of the guitar remotely from the bridge assembly, with the strings stretched between the bridge and the tuner assembly.

Figure 9:
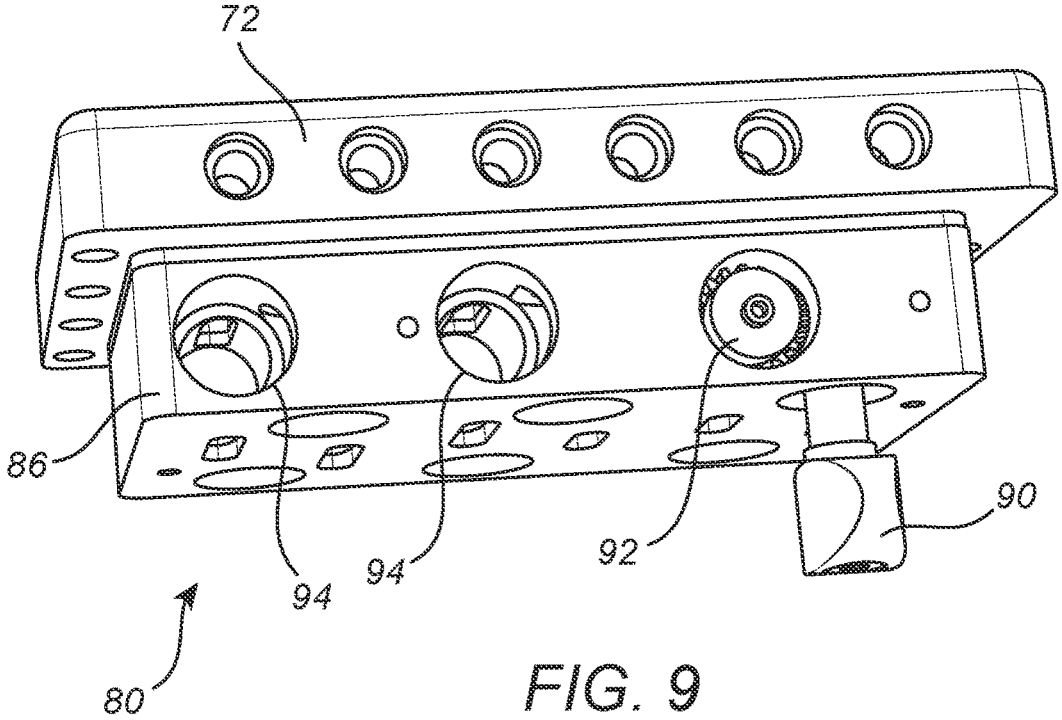
FIG. 9 is a perspective view illustrating some of the assembled parts of the tuning assembly of FIG. 7 before being mounted on a stringed instrument, according to various embodiments.

FIG. 9 is a perspective side view of some of the assembled parts of the tuning assembly 80 before the tuning assembly 80 is mounted on a stringed instrument (e.g., headless electric guitar 60). In this embodiment, the housing 86 of the tuning assembly 80 may be attached to the bridge 72 and aligned as shown. The tuning assembly 80 may include a plurality of worm wheels 92 that are configured to be inserted in corresponding worm wheel chambers 94. In this embodiment where three knobs 90 are positioned along opposite edges of the housing 86, the side of the tuning assembly 80 (as shown in FIG. 9) includes three worm wheel chambers 94. Only one worm wheel 92 and knob 90 is shown in FIG. 9 in order to show the inside characteristics of the worm wheel chambers 94.

Figure 10:
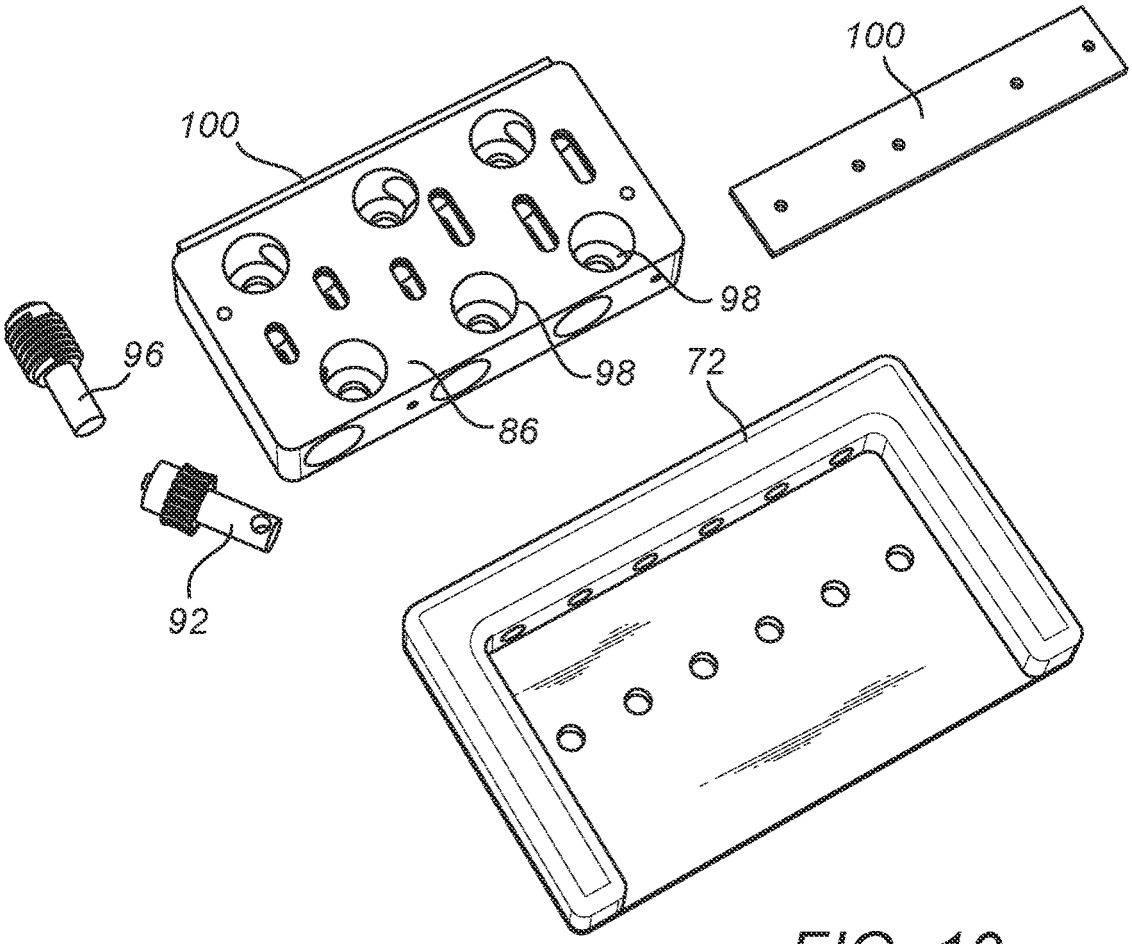
FIG. 10 is a perspective view illustrating the disassembled parts of the tuning assembly of FIG. 7, according to various embodiments.

FIG. 10 shows the parts of the tuning assembly 80 when disassembled. In addition to the bridge 72 and housing 86, the tuning assembly 80 further includes one or more worm wheels 92 configured to reside within the worm wheel chambers 94 extending through the side wall of the housing 86. The tuning assembly 80 also includes one or more worm shafts 96 that are configured to reside in the worm shaft chambers 98 extending through a top surface of the housing 86. When the worm wheels 92 (three worm wheels in this embodiment) are installed in the worm wheel chambers 94, one of the side panels 100 can be connected to that side of the housing 86 to keep the worm wheels 92 in place, while allowing them to rotate as needed for tuning.

Each worm wheel 92 is paired with a corresponding worm shaft 96 to form a gear mechanism for converting a first rotational force about a first axis to a second rotational force about a second axis. In the illustrated embodiment, the first axis and second axis may be configured substantially perpendicular to each other. However, according to other embodiments, the worm wheel 92 and worm shaft 96 may be configured (along with corresponding chambers 94, 98) to include any angle (e.g., from about 45° to about 135°) between the first axis and the second axis. For example, each pair of worm wheel 92 and worm shaft 96 may be angled (e.g., 60°) such that the knobs 90 are also angled correspondingly, which may be configured for saving space in some cases. For example, one worm shaft 96 residing in one of the worm shaft chambers 98, when rotated, is configured to engage with one worm wheel 92 residing in a corresponding worm wheel chamber 94 and cause that worm wheel 92 to rotate. As shown in FIG. 10, each worm wheel chamber 94 is slightly offset from its corresponding worm shaft chamber 98 to allow the teeth on the outside of the worm shaft 96 to engage with the teeth of the worm wheel 92.

Figure 11:
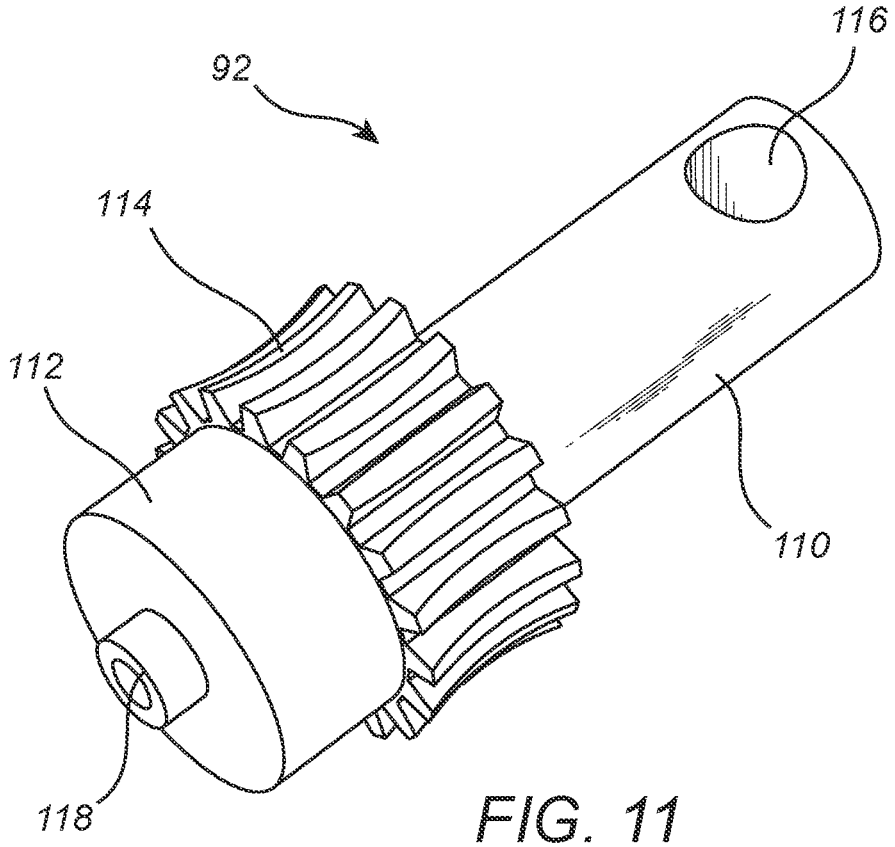
FIG. 11 is a perspective close-up view illustrating a worm wheel of the tuning assembly of FIG. 7, according to various embodiments.

FIG. 11 is a close-up view of an embodiment of one of the worm wheels 92. The worm wheel 92 of FIG. 11 includes an inner rod 110 that is inserted into the interior of the housing 86. The worm wheel 92 also includes an outer rod 112 and a centrally-located worm gear 114. The inner rod 110 includes a string anchor through-hole 116, which is configured to receive the end of a string to be tuned. By rotating the worm wheel 92 about its longitudinal axis, the string anchor through-hole 116 is configured to hold the string firmly to enable the string to be tightened as needed to tune the string. Also, the outer rod 112 includes an outer nub 118 which is configured to sit inside a corresponding aperture in the side panel 100 (or an equivalent structure in a side of the tuner housing) to allow the worm wheel 92 to rotate with little resistance.

Figure 12:
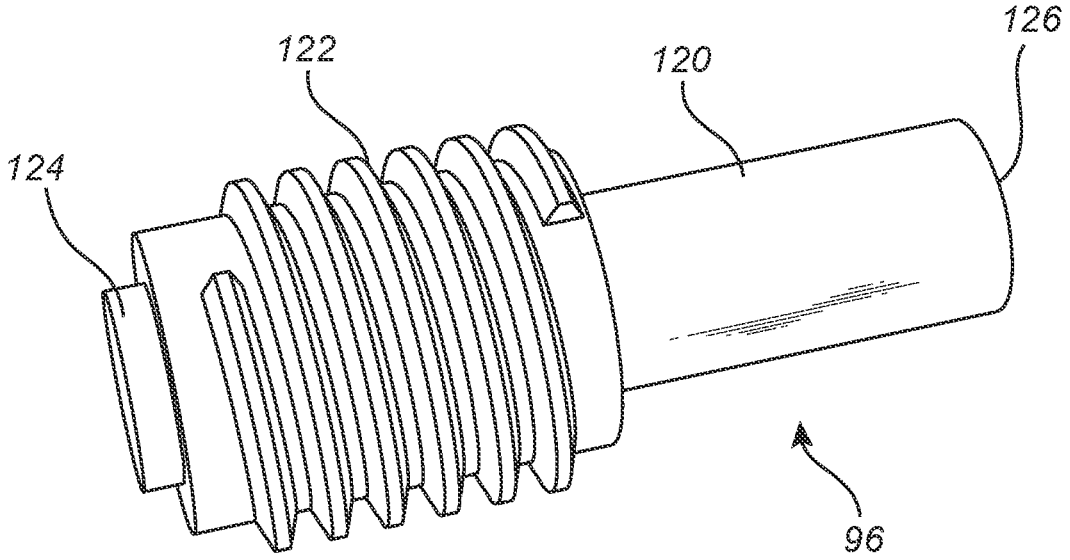
FIG. 12 is a perspective close-up view illustrating a worm shaft of the tuning assembly of FIG. 7, according to various embodiments.

FIG. 12 is a close-up view of one of the worm shafts 96 of the tuning assembly 80. The worm shaft 96 includes a bottom rod 120 that is configured to be inserted down through the corresponding worm shaft chamber 98. The worm shaft 96 also includes a worm gear 122 and a top nub 124. The top nub 124 is configured to sit in a recess in a bottom surface of the bridge 72, allowing the worm shaft 96 to rotate with little resistance. Also, the bottom rod 120 includes a fastener hole 126 configured to receive a fastener (e.g., screw) for connecting a knob (e.g., knob 90) to the bottom rod 120 of the worm shaft 96. In this way, the worm shaft 96 can be rotated by a user manually twisting the respective knob.

The worm gear 122 has teeth configured to engage with the worm gear 114 of the respective worm wheel 92. As shown in FIGS. 11 and 12, the teeth of the worm gear 114 of the worm wheel 92 (FIG. 11) are aligned substantially in parallel with the longitudinal axis of the worm wheel 92 and the teeth of the worm gear 122 of the worm shaft 96 (FIG. 12) are aligned substantially perpendicularly with the longitudinal axis of the worm shaft 96. Thus, in the embodiments where the worm wheel 92 and worm shaft 96 are positioned such that their longitudinal axes cause their corresponding teeth to engage, the worm gear 114 engages with the worm gear 122 such that, as the worm shaft 96 is rotated in one direction (e.g., clockwise), the gearing system causes the worm wheel 92 to rotate in the opposite direction (e.g., counter-clockwise). Again, the longitudinal axes of each pair of worm wheels 92 and worm shafts 96 may be oriented at any suitable angle (e.g., about 45° to about 135°).

Figure 13:
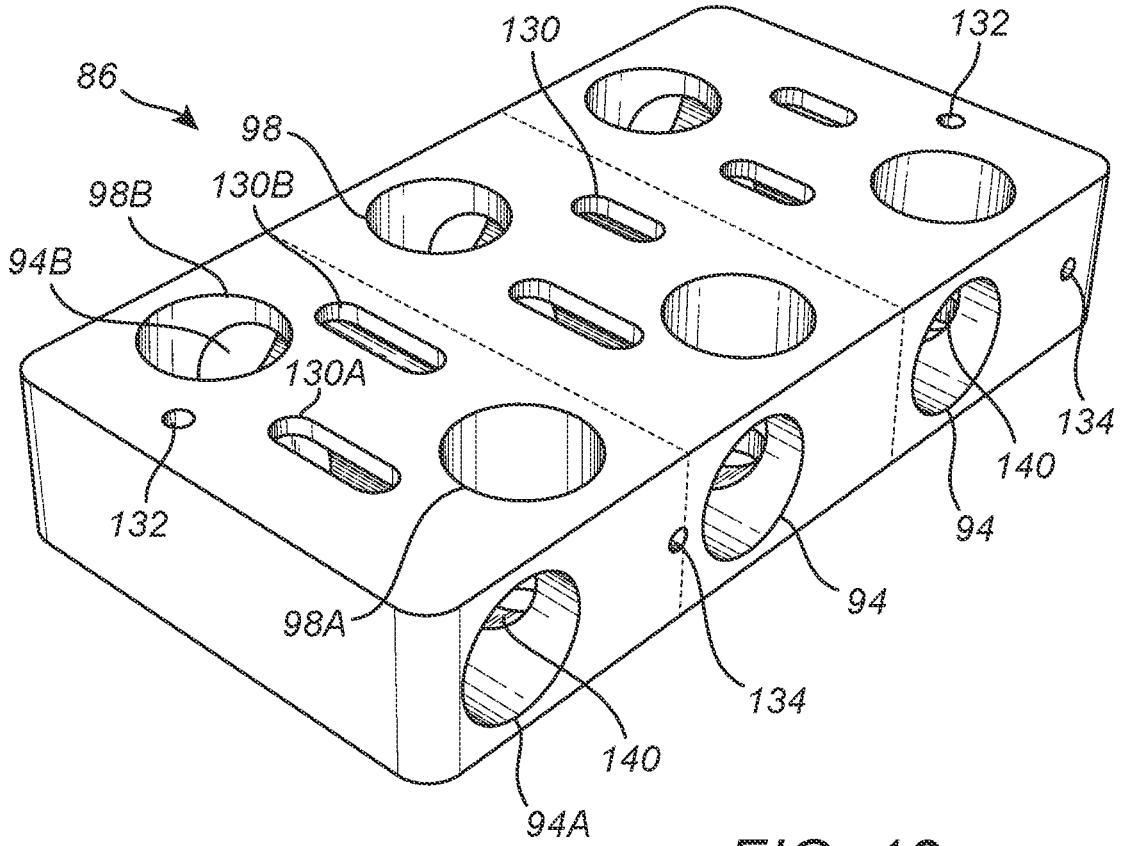
FIG. 13 is a top perspective view of a housing of the tuning assembly of FIG. 7, according to various embodiments.
Figure 14:
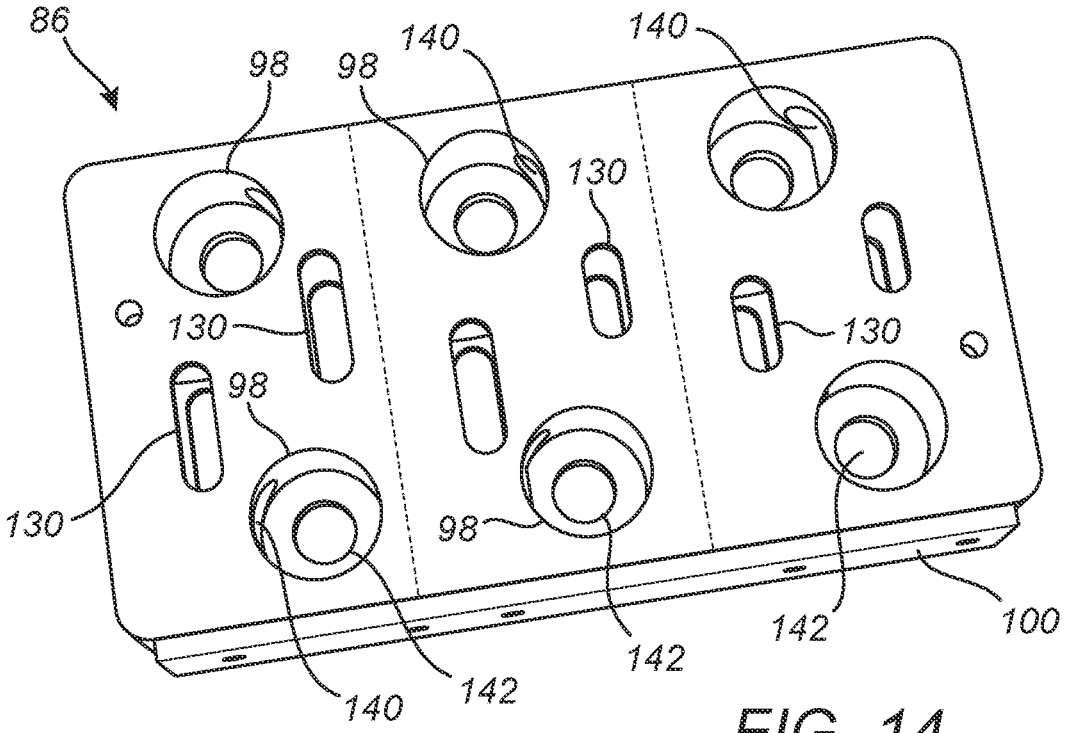
FIG. 14 is another top perspective view of the housing of FIG. 13, according to various embodiments.

FIG. 13 is a top perspective view of an embodiment of the housing 86 of the tuning assembly 80 shown in FIGS. 7-10. Also, FIG. 14 shows a top view of the housing 86. The term "top" in this respect refers to the side of the housing 86 facing upward when the body 62 of the headless electric guitar 60 is sitting on surface such that the strings 68 are on top. As mentioned above, the housing 86 may include the worm wheel chambers 94 extending through one or both sides thereof for receiving the worm wheels 92. When positioned on opposite sides, the worm wheel chambers 94 are offset from each other so that they do not intersect. The housing 86 may also include the worm shaft chambers 98 extending through a top surface thereof.

Figure 3:
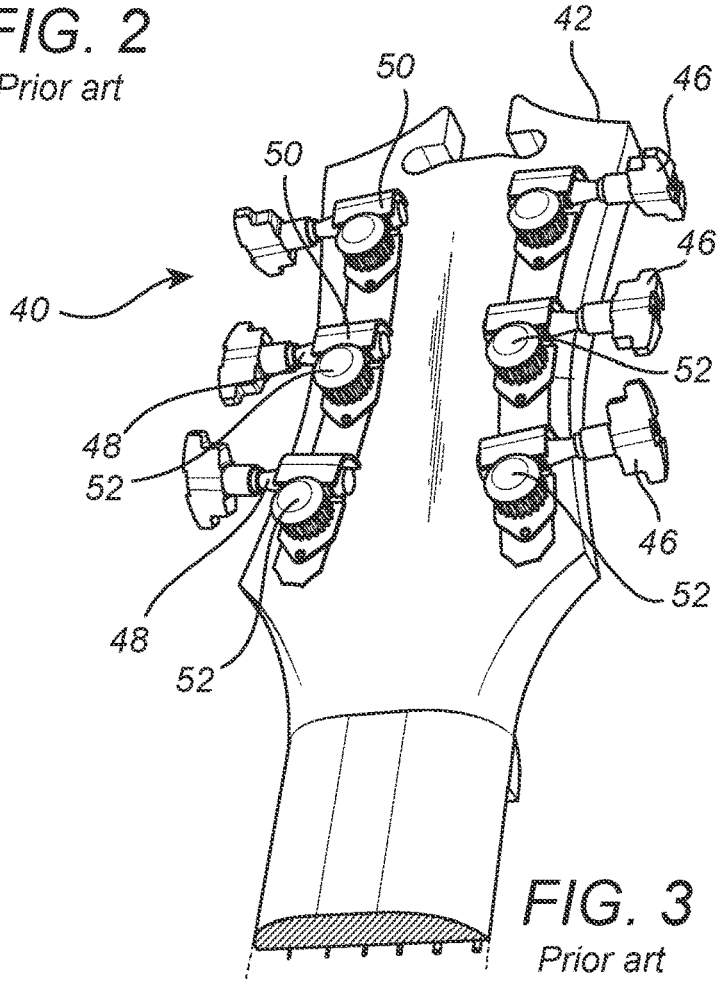
FIG. 3 Prior art
FIG. 3 is a back view of the head of the conventional acoustic guitar shown in FIG. 2 for showing the conventional tuning mechanisms.

In addition to the chambers 94, 98, the housing 86 further includes string apertures 130 (or string slots) configured to receive the ends of the strings when the strings are installed. The string apertures 130 may have any suitable shape, which may depend on the arrangement of through-holes in a corresponding bridge in some embodiments. Each of the string apertures 130 connects with a corresponding one of the worm wheel chambers 94. For example, worm wheel chamber 94A has an opening that connects to the opening in string slot 130A. When new strings are being installed on the stringed instrument, the end of the string is inserted down through the string slot and through the string anchor through-hole 116 (FIG. 11) of the worm wheel 92. To secure the string in the string anchor through-hole 116, the worm wheel 92 is rotated until the string starts to become taut. As described in more detail below, the worm wheel chambers 94 may include inner surfaces that are configured to bend the inserted string around the inner rod 110 of the worm wheel 92 to hold the string in place. Also, the contact between the string and the inner surface of the worm wheel chamber 94 causes a resistance that keeps the tuning mechanism 80 from being forced out of tune. In other words, the tuning mechanism 80 provides a self-locking feature, which is provided in lieu of the locking mechanisms 52 shown in FIG. 3 of the conventional tuning device 40.

The housing 86 may also include top screw holes 132. Although two top screw holes 132 are shown in FIGS. 13 and 14, it should be understood that any number of holes 132 may be formed (e.g., drilled) through the housing 86. The top screw holes 132 may be aligned with corresponding fastening holes (e.g., screw holes) in the bridge 72 such that a fastener (e.g., screw) inserted up through the bottom of the housing 86 can be fastened to the bridge 72 for keeping the housing 86 and bridge 72 together and properly aligned. The housing 86 also include one or more side screw holes 134 on each side surface of the housing 86 to allow the side panel 100 to be connected to the housing 86. By connecting the side panel 100 to the side of the housing 86, the side panel 100 is configured to keep the worm wheels 92 inside the worm wheel chambers 94.

In some embodiments, as suggested above, an alternative housing may be configured such that it includes two worm wheel chambers 94. For example, in this alternative embodiment, the housing may include a first worm wheel chamber 94A on one side and a second worm wheel chamber 94B (partially shown) on the other side. The string slots 130A, 130B correspond to worm wheel chambers 94A, 94B, respectively. A first worm shaft chamber 98A is configured in mechanical communication to correspond with the first worm wheel chamber 94A and a second worm shaft chamber 98B is configured in mechanical communication to correspond with the second worm wheel chamber 94B. Thus, the housing 86 as shown in FIG. 13 may instead be configured as three separate modules, where each module would include a specific portion of the housing 86 as divided according to the dashed lines. In this respect, the modules may be combined together to form a tuning assembly having any even number of tuning devices for tuning any even number of strings. Specifically, a first module in this arrangement would include elements 94A, 98A, 130A, 94B, 98B, and 130B. In various embodiments, any arrangement of single, dual, or plural modules can be combined to form a tuning assembly to accommodate any odd number or even number of strings of an instrument.

As shown more clearly in FIG. 14, the housing 86 includes gear engagement openings 140 between each corresponding pair of worm wheel chambers 94 and worm shaft chambers 98. The teeth of the worm gear 114 of the worm wheel 92 and the teeth of the worm gear 122 of the worm shaft 96 are configured to intersect in the gear engagement openings 140 to allow the transfer of force from one component to the other. On bottom of the worm shaft chambers 98, shaft holes 142 are formed to allow the bottom rods 120 of the worm shafts 96 to be inserted therethrough.

Figure 15:
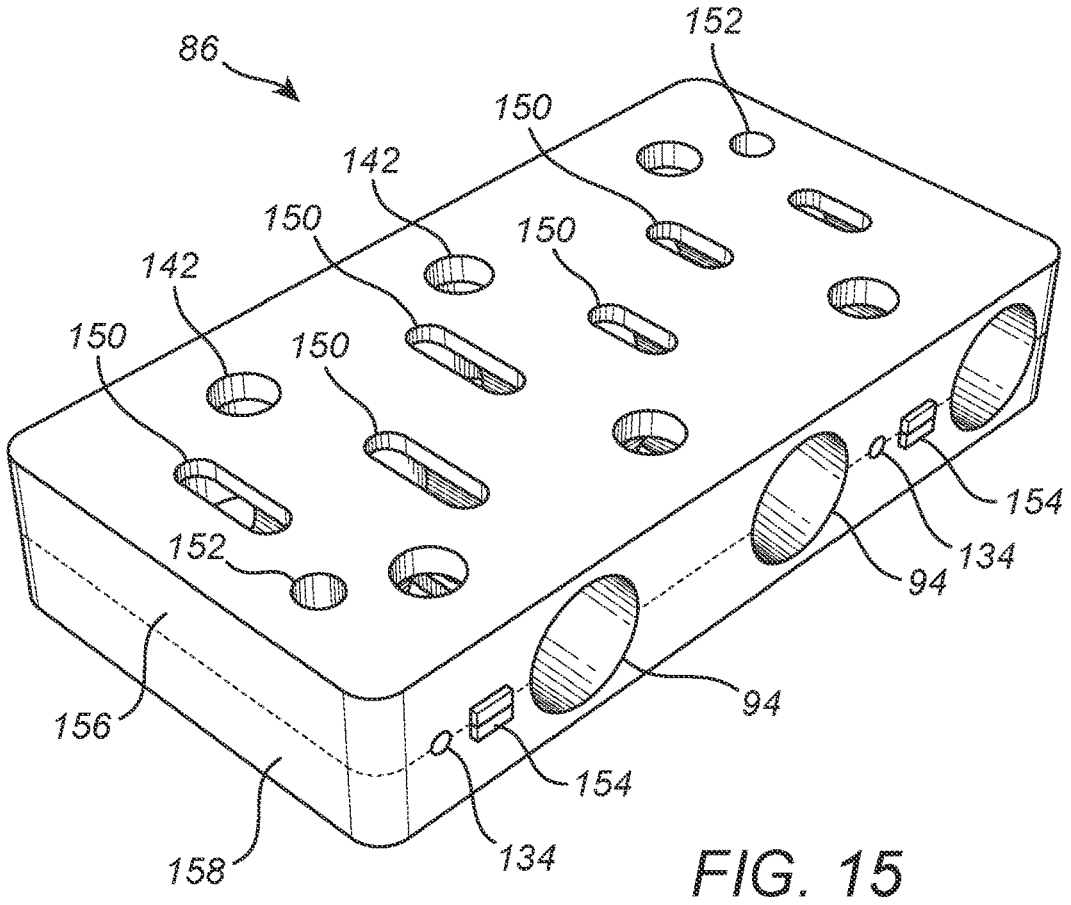
FIG. 15 is a bottom perspective view of the housing of FIG. 13, according to various embodiments.
Figure 16:
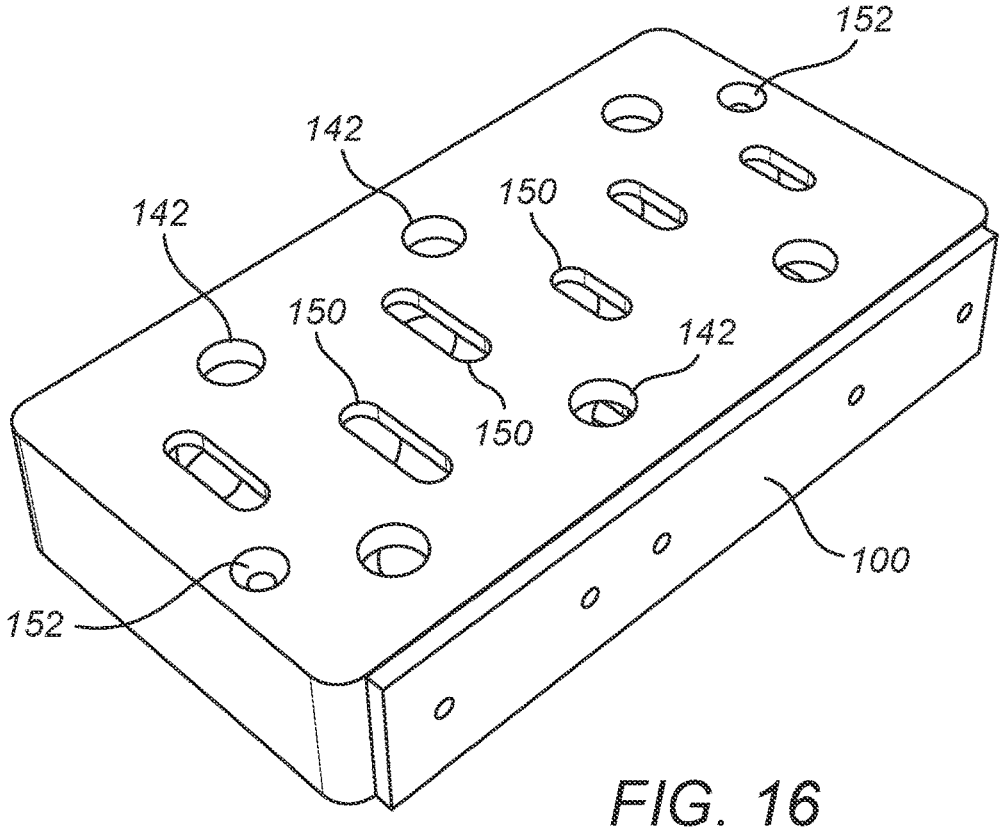
FIG. 16 is another bottom perspective view of the housing of FIG. 13, according to various embodiments.

FIGS. 15 and 16 show bottom perspective views of the housing 86. The term "bottom" in this respect refers to the side of the housing 86 facing downward when the body 62 of the headless electric guitar 60 is sitting on surface such that the strings 68 are on top. Again, the sides of the housing 86 include worm wheel chambers 94 and side screw holes 134. A bottom surface of the housing 86 includes the shaft holes 142 through which the bottom rods 120 of the worm shafts 96 extend, having been inserted into the worm shaft chambers 98 on the opposite side of the housing 86. The bottom rods 120 extend up through the shaft holes 142 such that knobs (e.g., knobs 90) can be attached to the worm shaft 96 (e.g., by a screw passing through the knob and screwed into the fastener hole 126 of the bottom rod 120 of the worm shaft 96.

The housing 86 may also include one or more viewing windows 150 on the bottom surface thereof. The viewing windows 150 may include any size or shape of openings that are connected to corresponding worm wheel chambers 94 and string slots 130. The viewing windows 150 may allow a user to view the strings inside the worm wheel chamber 94. Also, the viewing windows 150 may also allow the loose ends of the strings to extend out in order that the user may clip the unused ends of the strings.

The housing 86 also includes one or more bottom screw holes 152 that correspond to the top screw holes 132 shown in FIGS. 13 and 14. The bottom screw holes 152 may include a tapered surface for receiving the head of a fastener (e.g., the head of a flat-head screw) so that the fastener can sit within the indented area so as to be substantially flush with the bottom surface of the housing 86.

According to alternative embodiments, the housing 86 may be formed in two parts and held together using hinges 154 or other suitable fastening elements, such as screws holding the parts together without hinges. In this case, the housing 86 may include a bottom half 156 and a top half 158 (separated by the dashed lines) that can pivot with respect to each other about the hinges 154. Also, the housing 86 may be configured with the features of the side panels 100 on either side for keeping the worm wheel chambers 94 closed. When configured in this manner, the housing 86 may be opened by pivoting halves 156, 158 with respect to each other via the hinges 154 to allow the worm wheels 92 and worm shafts 96 to be installed in the housing 86 without the need for the side panels 100 and corresponding features.

Figure 17:
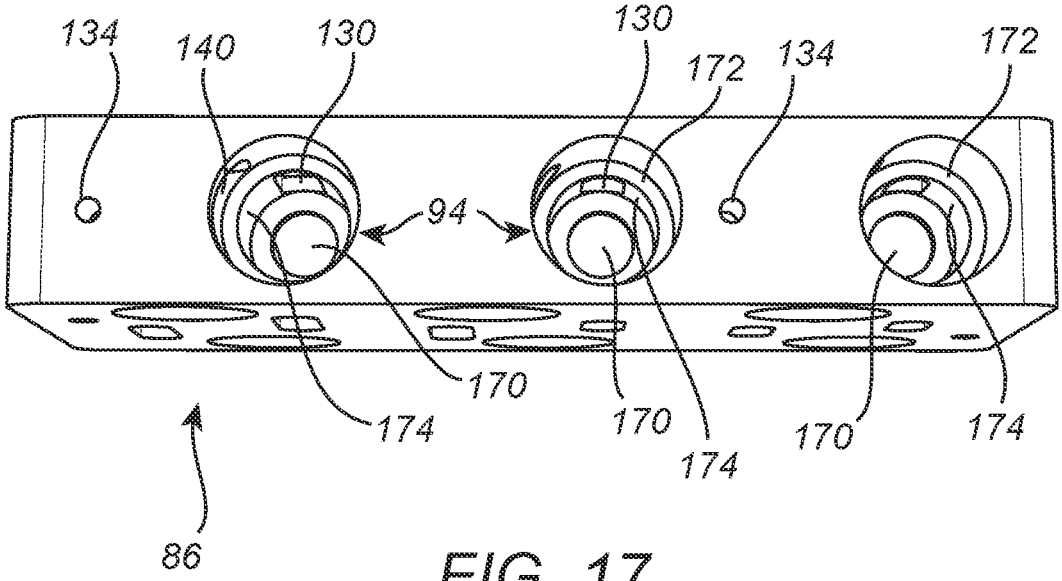
FIG. 17 is a perspective side view of the housing of FIG. 13, according to various embodiments.

FIG. 17 is a perspective side view of the housing 86. In this view, the inside of each of the worm wheel chambers 94 on one side of the housing 86 is shown. The worm wheel chambers 94 are connected with corresponding worm shaft chambers 98 via the gear engagement openings 140. The worm wheel chambers 94 are also connected with corresponding string slots 130. When a worm wheel 92 is inserted into the worm wheel chamber 94, the end of the inner rod 110 sit in an inner rod depression 170 configured to allow the worm wheel 92 to rotate about its longitudinal axis. Each of the worm wheel chambers 94 includes a shelf 172 that positions the worm gear 114 next to the gear engagement opening 140. Also, the shelf 172 forms a reduced volume where the end of the string can be wound. An inside surface 174 of the inner volume of each of the worm wheel chambers 94 may be configured to press against the wound string and form one or more bends in the string around the through-hole 116 to keep the string from slipping out of the string anchor through-hole 116 of the worm wheel 92. This provides a "self-locking" function for keeping the strings in tune and eliminates the need for a locking device, such as the locking mechanism 52 shown in FIG. 3. Also, the inside surface 174 of the reduced volume keeps the string tightly wound around the inner rod 110 of the worm wheel 92 to thereby press the side portion of the string against the edge of the string anchor through-hole 116 of the worm wheel 92 to keep the string from slipping out of the string anchor through-hole 116. Also, it should be noted that the inner dimensions of the inner surface 174 of the different worm wheel chambers 94 may be different and may be based on the size of the string being held. For example, the width of guitar strings may range from about 0.008 inches to greater than 0.060 inches. Thus, the space between the inner rod 110 of the worm wheel 92 and the inner surface 174 of the worm wheel chamber 94 for each particular string may be sized accordingly to enable a predetermined amount of resistance for self-locking.

Figure 18:
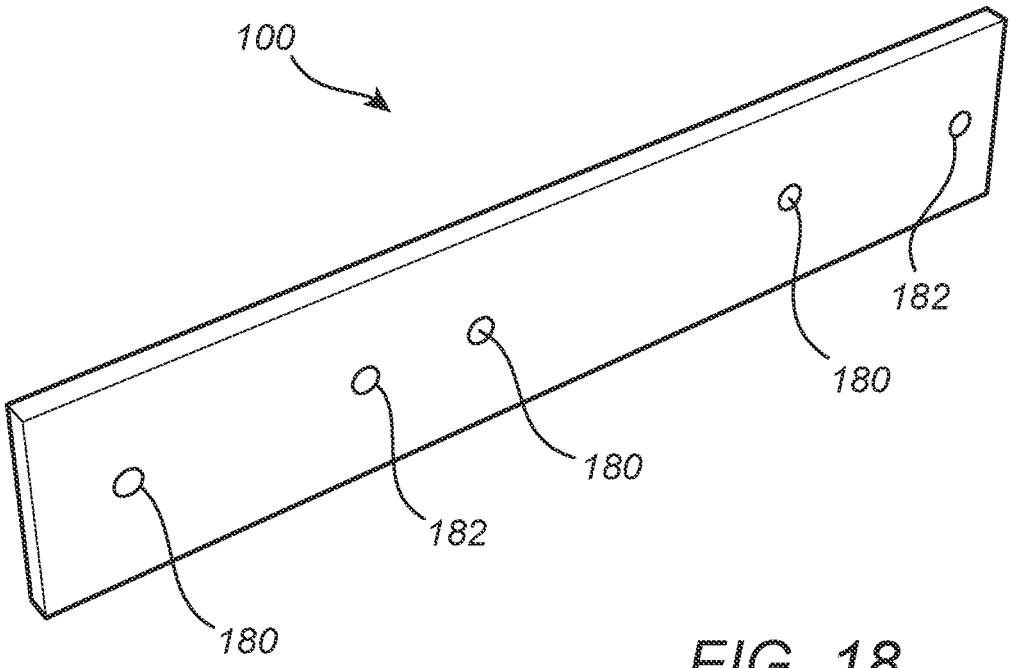
FIG. 18 is a perspective view of a side panel of the tuning assembly of FIG. 7, according to various embodiments.

FIG. 18 is a perspective view of the side panel 100 of the tuning assembly 80. The side panel 100 is configured to be attached to one of the long sides of the housing 86 for maintaining the worm wheels 92 inside the worm wheel chambers 94. The side panel 100 includes side holes 180 that are aligned with the worm wheel chambers 94 and may be configured to correspond with the outer dimensions of the outer rod 112 and/or outer nub 118 of the worm wheel 92. Thus, the outer nub 118 and/or outer rod 112 of the worm wheel 92 may be kept within the worm wheel chamber 94 while easily rotating within the side holes 180. The side panel 100 further includes screw holes 182 aligned with the screw holes 134 in the side surface of the housing 86. Screws (or other fasteners) may be inserted through the screw holes 182, 134 to secure the side panel 100 to the housing 86. In alternative embodiments, the functions of side panels 100 may be achieved by incorporating suitable features in the side walls of the housing when using certain manufacturing processes, such as casting.

Figure 19:
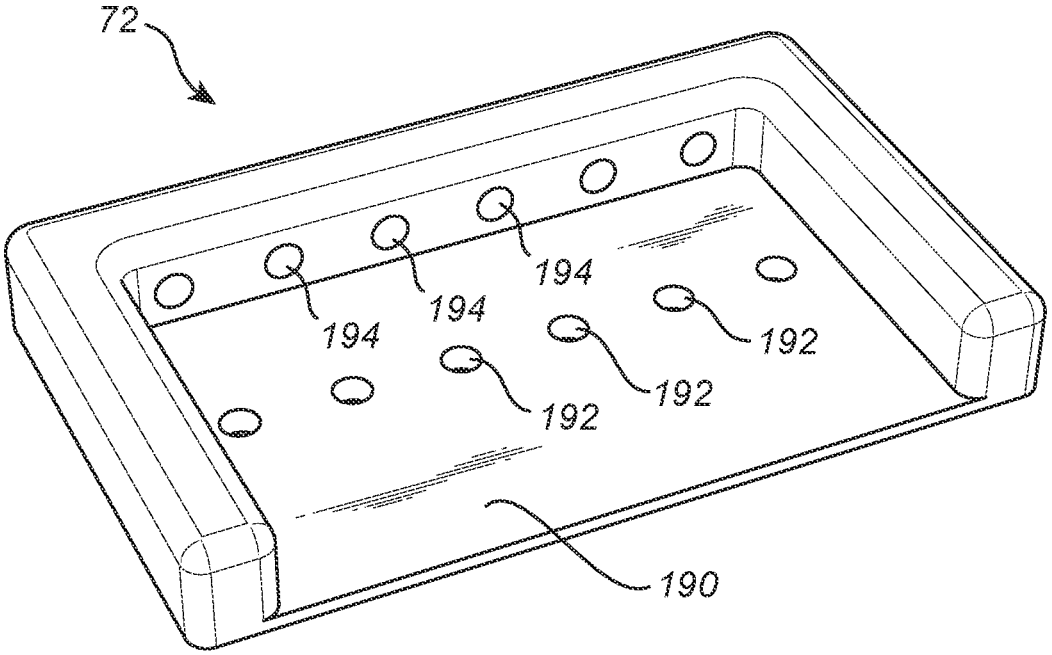
FIG. 19 is bottom perspective view of the bridge of FIG. 18, according to various embodiments.

FIG. 19 is top perspective view of the bridge 72. The bridge 72 includes a base 190 through which string drop apertures 192 are formed. The string drop apertures 192 are configured to be aligned with the string slots 130 in the top of housing 86 so that strings, when installed, can be inserted down through the string drop apertures 192 and through the string slots 130. As shown in FIG. 19, the string drop apertures 192 are aligned in a row. However, according to other embodiments, the string drop apertures 192 may be arranged in any suitable configuration, such as a zig-zag pattern. The string slots 130 of the housing 86 may be sized and arranged to correspond to either the aligned row (as shown) and/or other pattern of string drop apertures 192. In some embodiments, the bridge 72 may also include apertures 194. The apertures 194 may be used to accommodate portions of springs used for holding the saddles 74 (FIG. 6) in place. In an alternative embodiment, the housing may be installed on a front side of the body 62 of a stringed instrument, whereby the strings may be directed over the saddles 74, through the apertures 194, and then into the string slots 130 on the housing 86.

Figure 20:
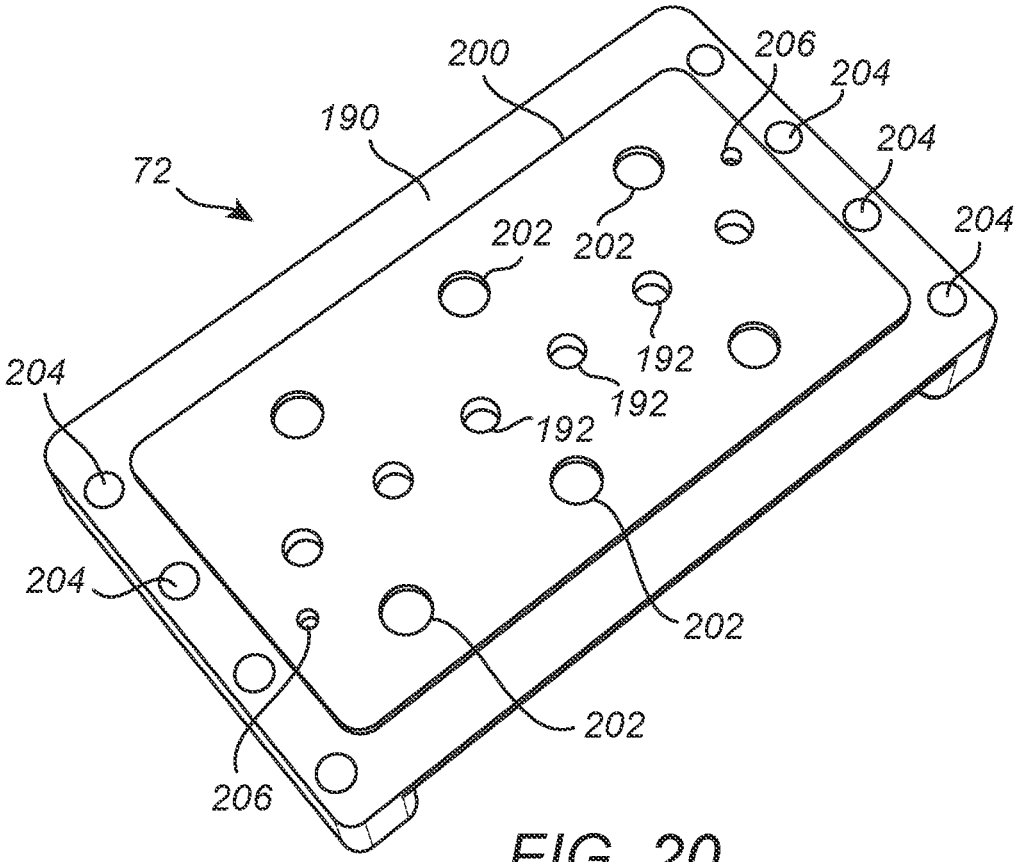
FIG. 20 is another bottom perspective view of the bridge of FIG. 18, according to various embodiments.

FIG. 20 is a bottom view of the bridge 72. The bridge 72 may include the base 190 and the apertures 192. Also, the bridge 72 may include a plateau 200 that is configured as a surface that extends above the base 190 (from the perspective of the bottom view). The plateau 200 may include a plurality of depressions 202 configured in alignment with the worm shaft chambers 98 of the housing 86. When the housing 86 is mounted to the bridge 72, the top nub 124 of the worm shaft 96 may be seated within the respective depression 202 to keep the worm shaft 96 in a proper position while allowing the worm shaft 96 to rotate with little resistance.

The bridge 72 also includes mounting screw holes 204, which may be configured near opposite edges of the bridge 72. The mounting screw holes 204 receive screws (or other suitable fasteners) for enabling the bridge 72 to be mounted onto the front surface of the body 62 of the headless electric guitar 60. The fasteners 82 may be inserted through holes through the body, as shown in FIG. 8, and through the mounting screw holes 204 to fasten the bridge 72 to the body 62. In addition, the bridge 72 includes housing screw holes 206, which are configured to be aligned with the top screw holes 132 (and bottom screw holes 152) for enabling the housing 86 to be secured to the bridge 72.

Therefore, according to various embodiments of the present disclosure, a tuning assembly may be configured to include a housing that includes a plurality of worm wheel chambers, a plurality of worm shaft chambers, and a plurality of string slots. The tuning assembly may also include a plurality of worm wheels configured to reside within the worm wheel chambers of the housing. Each worm wheel may be configured to rotate about a longitudinal axis thereof. Each worm wheel may include a first worm gear and a string anchor through-hole. Also, the tuning assembly may include a plurality of worm shafts configured to reside within the worm shaft chambers of the housing. Each worm shaft may be configured to rotate about a longitudinal axis thereof and may include a second worm gear.

The tuning assembly may further be defined wherein, within an interior volume of the housing, each worm wheel chamber may be configured to partially intersect with a corresponding worm shaft chamber at a gear engagement opening to enable the first worm gear of the respective worm wheel to engage with the second worm gear of the respective worm shaft. Also, the string anchor through-hole of each worm wheel may be configured to extend through an inner rod of the worm wheel, where the inner rod may be aligned with at least a portion of the respective string slot of the housing to allow a string of a stringed instrument to be inserted through the string anchor through-hole of the respective worm wheel via the respective string slot. The housing may be configured to be mounted in an opening on a back side of a body of a stringed instrument.

The tuning assembly may be configured to tune a plurality of strings of a stringed instrument by rotation of the worm shafts. The housing may be configured to be secured to a bridge mounted on a front side of the body of the stringed instrument. The bridge may include a plurality of string drop apertures aligned with at least a portion of the string slots of the housing to enable the strings to be inserted through the string anchor through-holes of the worm wheels via the string drop apertures and the string slots. The bridge may include a plurality of depressions configured to accommodate top nubs of the worm shafts to keep the worm shafts within the worm shaft chambers, the depressions being further configured to allow the worm shafts to rotate about the longitudinal axis of the respective worm shaft.

The tuning assembly may further comprise one or more panels configured to be secured to the housing, where the panels may be configured to cover at least a portion of one or more worm wheel chambers to keep the one or more worm wheels within the one or more respective worm wheel chamber. The tuning assembly may also include a plurality of knobs configured to be fixedly connected to bottom rods of the worm shafts extending out through shaft holes of the housing positioned on an opposite side of the housing from the worm shaft chambers. The housing may further include one or more viewing windows positioned on an opposite side of the housing from the string slots.

According to other embodiments of the present disclosure, the tuning assembly may be divided in a plurality of tuning modules, where each module is configured for tuning one or two strings. Thus, any number of modules can be combined on a stringed instrument to tune the strings. For example, when tuning modules are each configured to tune two strings and a stringed instrument includes six strings, three of these modules may be combined on the instrument for tuning all six strings. In an embodiment where each module is configured to tune just one string, the tuning module may include a housing that includes a worm wheel chamber, a worm shaft chamber, and a string slot. The tuning module may also include a worm wheel that includes a first worm gear and a string anchor through-hole. The worm wheel may be configured to reside within the worm wheel chamber of the housing and rotate about a longitudinal axis of the worm wheel. The tuning module may also include a worm shaft that includes a second worm gear, where the worm shaft may be configured to reside within the worm shaft chamber of the housing and rotate about a longitudinal axis of the worm shaft.

In this single-string tuning device, the tuning module may further be configured such that, within an interior volume of the housing, the worm wheel chamber partially intersects with the worm shaft chamber at a gear engagement opening to enable the first worm gear of the worm wheel to engage with the second worm gear of the worm shaft. Also, the string anchor through-hole of the worm wheel may extend through an inner rod of the worm wheel, where the inner rod may be aligned with at least a portion of the string slot of the housing to allow a string of a stringed instrument to be inserted through the string anchor through-hole of the worm wheel via the string slot. The housing may be configured to be mounted in an opening on a back side of a body of a stringed instrument. In response to a user rotating the worm shaft, the tuning module is configured to tune a string of an instrument. The tuning module may further comprise a plurality of worm wheels and a plurality of worm shafts, wherein the housing includes a plurality of worm wheel chambers and a plurality of worm shaft chambers, and wherein the plurality of worm wheels are configured to reside within the plurality of worm wheel chambers and the plurality of worm shafts are configured to reside within the plurality of worm shaft chambers.

The present disclosure is also directed to a stringed instrument or stringed musical instrument that includes the tuning assemblies described herein. The stringed instrument may be an electric guitar, acoustic guitar, mandolin, electric bass, upright bass, banjo, violin, cello, piano, harp, or other type of instrument having at least one string. According to some embodiments, a stringed instrument may include a plurality of strings and a tuning assembly configured to individually tune each of the plurality of strings. The tuning assembly may include a housing that includes a plurality of worm wheel chambers, a plurality of worm shaft chambers, and a plurality of string slots through which free ends of the strings are inserted. Also, the tuning assembly may include a plurality of worm wheels configured to reside within the worm wheel chambers of the housing, where each worm wheel is configured to rotate about a longitudinal axis thereof and each worm wheel includes a first worm gear and a string anchor through-hole. The tuning assembly further includes a plurality of worm shafts configured to reside within the worm shaft chambers of the housing, where each worm shaft is configured to rotate about a longitudinal axis thereof and each worm shaft includes a second worm gear.

The stringed instrument may further comprise a body and a neck, wherein the strings are fixed at one end of the neck and are adjustable at the other end of the neck to enable tuning of the strings. The tuning assembly may be configured to be secured to a bridge mounted on a front side of a body through an opening on a back side of the body, whereby the bridge may include a plurality of string drop apertures aligned with at least a portion of the string slots of the housing to enable the strings to be inserted through the string anchor through-holes of the worm wheels via the string drop apertures and the string slots. The bridge may include a plurality of depressions configured to accommodate top nubs of the worm shafts to keep the worm shafts within the worm shaft chambers, whereby the depressions may be further configured to allow the worm shafts to rotate about the longitudinal axis of the respective worm shaft. The tuning assembly may further include a plurality of knobs configured to be fixedly connected to bottom rods of the worm shafts extending out through shaft holes of the housing positioned on an opposite side of the housing from the worm shaft chambers, whereby rotation of the knobs is configured to tune the strings.

The present disclosure provides many embodiments that seek to overcome the problem of the conventional tuning systems in a novel way. With the embodiments described herein, the tuners are miniaturized versions of standard worm gear tuners, aligned in a compact housing in such a way that standard finger tightened "buttons" can be used. The housing can then be mounted directly below the bridge assembly, and even attached to it, to make a one-piece integrated tuner/bridge mechanism. This eliminates any extra length, either at the head of the neck, or in the body of the instrument.

Through the use of a double kinking arrangement, the tuner becomes "self-locking" within a few turns of the tuning knobs 90. This prevents the need for locking screws, and of special tying and winding practices. Also, the present design of the various embodiments can allow the strings to be self-trimmed to length, by placing a cutter near the viewing windows 150. Any number of strings, any scale length and any string size can be accommodated through layout modifications as would be understood by one or ordinary skill in the art equipped with the teachings of the present disclosure. The tuning assemblies can be used with essentially any kind of stringed instrument, such as guitars (e.g., standard six-string, 12-string, bass, baritone, tenor, short-scale, etc.), mandolins, ukuleles, and even instruments such as violins can be designed around this concept.

The embodiments of the present disclosure may be designed particularly for "headless" instruments where the tuning assemblies are mounted on the body of the instrument, although some embodiments may allow for implementation in a standard arrangement where the tuning assemblies are mounted on the head. It should also be recognized that a guitar is normally built to withstand the forces caused by holding the strings taut. A standard string in a headless guitar may be held behind the nut and tightened to such a force (about 20 pounds per string) to hold the strings tight. Thus, with a six-string guitar, the pulling force of the tightened strings may normally be about 120 pounds on the stub 66. To secure the end of the neck 64 and the stub 66 of the headless guitar, a metal plate may be screwed to the head. In some embodiments, holes may be placed in the wood or other material of the stub 66. All that is required is to align the strings in such a way that they are held securely to the slots in the nut, which can be implemented in any number of ways.

The present disclosure describes tuning assemblies having two main parts, that is, the bridge and the tuner housing. The bridge may be similar to a standard, off-the-shelf bridge, with a number of saddles screwed into the back of the bridge that hold the strings in place. The system may also use saddles similar to standard, off-the-shelf saddles, where factors such as string height, intonation, fingerboard radius, and so on can be adjusted, as they can in conventional instruments. Unlike standard bridges, however, the bridge of the present embodiments includes securing screws that can be brought up through the guitar body, resulting in a clean, uninterrupted, and smooth playing surface. The strings are directed over the saddles and then immediately down through holes in the bridge and into the cavity below the bridge. This allows the strings to be held firmly in place, without the concerns of a string sliding out of its groove. In some embodiments, the bridge may be attached to a spring mounted plate to include a "tremolo" function (e.g., also known as a "vibrato" function or "whammy"). In various embodiments, the bottom of the bridge may extend into the machined cavity of the body by a small amount to allow for self-alignment. In other implementations, the bridge may include other styles (e.g., Tune-O-Matic, roller bridges, Nashville, etc.) and may be used with the tuner housing mounted below in the body, or on top of the body. The design described herein has been developed with the intent of making a compact design with an adjustable bridge.

The tuner housing assembly is novel compared to traditional designs. The housing may include one or more solid pieces of material (e.g., metal, steel, stainless steel, aluminum, plastic, ceramic, composites, wood, or any suitable material or materials). The housing may be machined, injection molded, cast, 3D printed, or created using any suitable manufacturing processes to form the design shown and described in the present disclosure. The housing may be configured to accept a number of worm gear pairs corresponding to the number of types of strings being used. The housing can then be attached directly to the bottom of the bridge, and the whole assembly then can be bolted to the body of the instrument through a cavity formed in the back of the body. The housing may be attached directly to the bridge for the sake of size and convenience, as described throughout the present disclosure. However, in other embodiments, the housing and bridge may be arranged in different ways. For instance, a securing plate may be added to the top of the tuner housing to hold the top of the worm shaft, which may allow the tuner housing to be placed anywhere in line with the strings.

Also, the combination of the gears can be designed with any suitable gear ratios, whereby a first number of turns on one component (e.g., worm shaft 96) translates to a second number of turns on another component (e.g., worm wheel 92). While the embodiments described herein use worm gears (e.g., 114, 122), other types of gear arrangements can be used to accomplish the same task of translating rotational force along one axis to a rotational force along another axis. For example, other embodiments may include but are not limited to rack-and-pinion gears, planetary gears, and other manual and automatic mechanisms, including direct pulling (e.g., turnbuckles), electrically or pneumatically operated motors, automatic/computer controlled tuning mechanisms, adjustable tightening mechanisms, etc. In some embodiments, the manual gears may be combined with or replaced by electric motors or other automatic or electrical tuning devices for providing a mechanical force when electrical power is supplied to the electric motors.

The tuner housing 86 may be formed by machining, casting, drilling, and/or by other manufacturing processes. The tuner housing 86 may have a series of holes formed into it for each of the miniaturized worm gears (e.g., the worm wheel 92 and the worm shaft 96) to be installed, as well as holes or slots for the string to pass completely through the housing. Worm gears are configured to provide self-locking functions. In the present disclosure, they may be formed into specific shapes and sizes to hold them in position correctly. According to some embodiments, the worm wheel 92 may sit "horizontally" (i.e., parallel to the body) and may be arranged substantially perpendicular to the direction of the respective string. The worm wheel 92 is the part that holds the string. Also, according to some embodiments, the worm shaft 96 may sit "vertically" (i.e., substantially perpendicular to the body) and may be arranged substantially parallel to the direction of the string. The worm shaft 96 is the part that holds the tuner button (e.g., knob 90) that the user twists for manual tuning.

Each of the worm wheels 92 may be enclosed in cylinders (e.g., worm wheel chambers 94) of varying diameters that correspond to the thicknesses of the strings being used. While the dimensions of these chambers 94 may vary and may be optimized for this particular application, all cylinder dimensions for any size string or gear shaft diameter in the housing are conceived. The worm wheel is secured on each end—at the end of the cylinder is a cutout for a small portion of, or projection on, the worm wheel to engage and turn freely (in this design, no bearings are used, but bearings may be used, but not allow lateral motion, and on the end where the worm wheel is installed, a small perforated plate is placed over a similar projection to also allow the wheel to turn freely, but allow no lateral motion. This small plate is secured to the side of the housing. There are other ways to install this gear (e.g., slotting the housing rather than drilling it, casting the parts with suitable features designed therein, etc.).

The worm wheel, thus constrained, is then turned by the worm shaft, which is secured in the housing on each end, with projections on either end to allow the gear to turn freely, but not move laterally. The "bottom" end has an extension that allows standard, off-the-shelf tuner knobs or buttons (or other devices) to be attached to turn it. The installation ("top") end can either be held in place by cutouts in the bridge (as in the various embodiments) or by a perforated plate secured to the top of the housing, or though some other means, such as slotting or casting with suitable features.

The instrument string is then routed from the bridge into the top hole of the housing, through a hole in the worm wheel, and finally through the housing and into open air. As the worm shaft is turned, the worm wheel turns, and the string is pulled into the cylinder. As the worm shaft turns, the string is kinked, once at the top, in one direction, and once at the bottom in the opposite direction. These opposing kinks get sharper as the gears are turned and eventually lock the string into place, typically within about one-quarter to one-half of one revolution, depending on the size and material of the string. Once locked into place, the string can be tightened to a precise tune, where it can remain in tune indefinitely. To release the string, one simply reverses the winding direction of the gears until the worm shaft holes align to the housing holes to allow the string to be pulled back out. In some embodiments, a cutting surface can be added to the point where the string exits the housing (e.g., through the viewing windows) in such a location that the string can be automatically cut to length.

Note that the worm gears may be arranged alternately one side and then the other. This allows the housing to have a smaller total space requirement of the tuner assembly, while providing enough room for fingers (or plastic tools, such as string winders) to fit into this space and adjust the tuning of the strings. However, the design can be easily modified from the illustrated implementations to allow the tuners to sit in any orientation and at any distance from one another. Furthermore, there is no limit on the number of gear assemblies that can be placed within a suitably sized and arranged housing, allowing for any number of strings of any size to be utilized on any instrument, e.g., for a bass guitar, a seven string guitar, sitar, etc.

The following are some the benefits of the various embodiments of the present disclosure with respect to the conventional tuning systems. One benefit is that the present tuning assembly includes a minimized size and spacing that is more compact than other tuners that may be installed on stringed, headless instruments. Another benefit is that the present tuning assembly minimizes design and manufacturing constraints on headless stringed instruments. It permits overall instrument size to be reduced significantly. For example, in some cases, the length of an instrument can be as little as 1.5 inches longer than the scale length.

Other benefits include that the tuner assemblies are permitted to be housed entirely within the footprint of the instrument, minimizing potential damage and/or bumping the tuners and therefore knocking it out of tune. The present embodiments allow for automatically locking the strings, eliminating the need for extra mechanisms. They allow for automatically cutting the strings, eliminating extra tools. They also allow the use of standard strings. They can significantly reduce the number of parts and manufacturing steps required to build a set of tuners. They permit the use of standard adjustments, such as height, fingerboard radius, and intonation. They provide a one-piece tuner/bridge assembly that can be prepared separately from the rest of the guitar and simply installed when the rest of the instrument is ready, in one step.

The tuning assemblies of the present disclosure also provide the benefits of being scalable and adjustable to fit any type of stringed instrument and any orientation of tuner button positions, as required by the instrument designer. They are easily tuned with fingers, where no tools are required. They permit headless instruments to have virtually nothing more than a hole to hold a string at the head end—no tools, screws or special parts are required. They are lightweight and compact and do not appreciably affect the overall balance of an instrument. They allow instrument bodies to be any size and/or shape, with no constraints on cutouts for gripping the tuners, as on Steinberger pull designs, nor complex string routing and tuner placement as with standard tuner designs. They can be assembled in only a few minutes, with few adjustments required, other than the usual string setup for an instrument. They permit installation on minimum size instruments, with all of the required tuning features and moving parts to provide tuning in one small integrated package. Also, the rigid bridge/tuner mechanism provides excellent sound capture and tonal attributes that are not matched with other setups. Also, they can be used with any type of stringed instrument, including, but not limited to, guitars, bass guitars, baritone guitars, ukuleles, banjos, violins, electric violins, violas, etc.

Although the present disclosure has been illustrated and described herein with reference to exemplary embodiments providing various advantages, it will be readily apparent to those of ordinary skill in the art that other embodiments may perform similar functions, achieve like results, and/or provide other advantages. Modifications, additions, or omissions may be made to the systems, apparatuses, and methods described herein without departing from the spirit and scope of the present disclosure. All equivalent or alternative embodiments that fall within the spirit and scope of the present disclosure are contemplated thereby and are intended to be covered by the following claims.

What is claimed is:

1. A tuning assembly having a self-locking feature, the tuning assembly comprising:

a housing that includes a plurality of worm wheel chambers, a plurality of worm shaft chambers, and a plurality of string slots;

a plurality of worm wheels configured to reside within the worm wheel chambers of the housing, each worm wheel configured to rotate about a longitudinal axis thereof, and each worm wheel including a first worm gear and a string anchor through-hole; and a plurality of worm shafts configured to reside within the worm shaft chambers of the housing, each worm shaft configured to rotate about a longitudinal axis thereof, and each worm shaft including a second worm gear;

wherein the string anchor through-hole of each worm wheel and an inner surface of a respective worm wheel chamber are configured to secure a string inserted through the string anchor through-hole and self-lock a tuning condition of the string.

2. The tuning assembly of claim 1, wherein, within an interior volume of the housing, each worm wheel chamber is configured to partially intersect with a corresponding worm shaft chamber at a gear engagement opening to enable the first worm gear of the respective worm wheel to engage with the second worm gear of the respective worm shaft.

3. The tuning assembly of claim 1, wherein the string anchor through-hole of each worm wheel extends through an inner rod of the worm wheel, and wherein the inner rod is aligned with at least a portion of the respective string slot of the housing to allow a string of a stringed instrument to be inserted through the string anchor through-hole of the respective worm wheel via the respective string slot.

4. The tuning assembly of claim 1, wherein the housing is configured to be mounted in an opening on a back side of a body of a stringed instrument.

5. The tuning assembly of claim 1, wherein the tuning assembly is configured to tune a plurality of strings of a stringed instrument by rotation of the worm shafts.

6. The tuning assembly of claim 5, wherein the housing is configured to be secured to or located adjacent to a bridge mounted on a front side of the body of the stringed instrument, and wherein the bridge includes a plurality of string drop apertures aligned with at least a portion of the string slots of the housing to enable the strings to be inserted through the string anchor through-holes of the worm wheels via the string drop apertures and the string slots.

7. The tuning assembly of claim 6, wherein the bridge includes a plurality of depressions configured to accommodate a portion of the worm shafts to keep the worm shafts aligned within the worm shaft chambers, the depressions further configured to allow the worm shafts to rotate about the longitudinal axis of the respective worm shaft.

8. The tuning assembly of claim 1, further comprising one or more panels configured to be secured to or formed within the housing, wherein the one or more panels are configured to cover at least a portion of one or more worm wheel chambers to keep the one or more worm wheels aligned within the one or more respective worm wheel chamber.

9. The tuning assembly of claim 1, further comprising a plurality of knobs or electric motors configured to be fixedly connected to bottom rods of the worm shafts extending out through shaft holes of the housing positioned on an opposite side of the housing from the worm shaft chambers.

10. The tuning assembly of claim 1, wherein the housing further includes one or more viewing windows positioned on an opposite side of the housing from the string slots.

11. A tuning module comprising:

a housing that includes a worm wheel chamber, a worm shaft chamber, and a string slot;

a worm wheel that includes a first worm gear and a string anchor through-hole, the worm wheel configured to reside within the worm wheel chamber of the housing and rotate about a longitudinal axis of the worm wheel; and a worm shaft that includes a second worm gear, the worm shaft configured to reside within the worm shaft chamber of the housing and rotate about a longitudinal axis of the worm shaft.

12. The tuning module of claim 11, wherein, within an interior volume of the housing, the worm wheel chamber partially intersects with the worm shaft chamber at a gear engagement opening to enable the first worm gear of the worm wheel to engage with the second worm gear of the worm shaft.

13. The tuning module of claim 11, wherein the string anchor through-hole of the worm wheel extends through an inner rod of the worm wheel, and wherein the inner rod is aligned with at least a portion of the string slot of the housing to allow a string of a stringed instrument to be inserted through the string anchor through-hole of the worm wheel via the string slot.

14. The tuning module of claim 11, wherein the housing is configured to be mounted in an opening on a back side of a body of a stringed instrument.

15. The tuning module of claim 11, wherein, in response to user rotating the worm shaft, the tuning module is configured to tune a string of an instrument, and wherein the string anchor through-hole of the worm wheel and an inner surface of the worm wheel chamber are configured to secure the string and self-lock a tuning condition of the string.

16. The tuning module of claim 11, further comprising a plurality of worm wheels and a plurality of worm shafts, wherein the housing includes a plurality of worm wheel chambers and a plurality of worm shaft chambers, and wherein the plurality of worm wheels are configured to reside within the plurality of worm wheel chambers and the plurality of worm shafts are configured to reside within the plurality of worm shaft chambers.

17. A stringed instrument comprising:

a plurality of strings; and a tuning assembly configured to individually tune each of the plurality of strings, the tuning assembly including:

a housing that includes a plurality of worm wheel chambers, a plurality of worm shaft chambers, and a plurality of string slots through which free ends of the strings are inserted;

a plurality of worm wheels configured to reside within the worm wheel chambers of the housing, each worm wheel configured to rotate about a longitudinal axis thereof, and each worm wheel including a first worm gear and a string anchor through-hole; and a plurality of worm shafts configured to reside within the worm shaft chambers of the housing, each worm shaft configured to rotate about a longitudinal axis thereof, and each worm shaft including a second worm gear.

18. The stringed instrument of claim 17, further comprising a body and a neck, wherein the strings are fixed at one end of the neck and are adjustable at the other end of the neck to enable tuning of the strings.

19. The stringed instrument of claim 18, wherein the tuning assembly is configured to be secured to or adjacent to a bridge mounted on a front side of a body through an opening on a back side of the body, wherein the bridge includes a plurality of string drop apertures aligned with at least a portion of the string slots of the housing to enable the strings to be inserted through the string anchor through-holes of the worm wheels via the string drop apertures and the string slots, wherein the bridge includes a plurality of depressions configured to accommodate top nubs of the worm shafts to keep the worm shafts within the worm shaft chambers, and wherein the depressions are further configured to allow the worm shafts to rotate about the longitudinal axis of the respective worm shaft.

20. The tuning assembly of claim 1, further comprising a plurality of knobs or electric motors configured to be fixedly connected to bottom rods of the worm shafts extending out through shaft holes of the housing positioned on an opposite side of the housing from the worm shaft chambers, wherein rotation of the knobs is configured to tune the strings.

* * * * *